US006088558A

United States Patent [19]

Yamada et al.

[11] Patent Number: 6,088,558

[45] Date of Patent: Jul. 11, 2000

[54] METHOD AND APPARATUS FOR SUPPRESSING BELT SHIFT IN AN IMAGE FORMING APPARATUS

[75] Inventors: Masamichi Yamada, Yokohama; Shigeo Kurotaka, Sagamihara, both of Japan

[73] Assignee: Ricoh Company, Ltd., Tokyo, Japan

[21] Appl. No.: 09/263,775

[22] Filed: Mar. 5, 1999

[30] Foreign Application Priority Data

Mar. 5, 1998 [JP] Japan ..... 10-053769
Sep. 3, 1998 [JP] Japan ..... 10-248980

[51] Int. Cl.[7] ..... G03G 15/20; G03G 21/00

[52] U.S. Cl. ..... 399/165; 399/329; 198/806

[58] Field of Search ..... 399/165, 329, 399/299, 300; 347/154; 226/18, 21, 23, 45; 198/806

[56] References Cited

U.S. PATENT DOCUMENTS 3,818,391 6/1974 Jordon et al. ..... 198/202 X
4,027,966 6/1977 Jordan ..... 198/806 X
4,483,607 11/1984 Nagayama .
5,157,444 10/1992 Mori et al. ..... 198/806 X
5,343,279 8/1994 Nagata et al. ..... 198/806 X
5,365,321 11/1994 Koshimizu et al. .
5,895,153 4/1999 Aslam et al. ..... 399/329

*Primary Examiner*—Richard Moses
*Attorney, Agent, or Firm*—Oblon, Spivak, McClelland, Maier & Neustadt, P.C.

[57] ABSTRACT

An image forming apparatus includes an endless belt, a pair of belt winding rollers that wind and rotate the endless belt, and a belt shift detecting device that detects a belt shift. The image forming apparatus further includes a roller end moving device that moves one end of one of the belt winding rollers around its other end in response to the detection of a belt shift to suppress the belt shift to a predetermined range, and a belt surface contacting device that pressure contacts the surface of the endless belt. The belt surface contacting device is mounted on a frame that supports a shaft of the belt winding roller to be moved so that its contacting condition does not change during the movement of the belt winding roller moved by the roller end moving device.

24 Claims, 25 Drawing Sheets

METHOD AND APPARATUS FOR SUPPRESSING BELT SHIFT IN AN IMAGE FORMING APPARATUS

BACKGROUND OF THE INVENTION

1. Field of the Invention

The present invention relates to an endless belt or film driving mechanism for use in an image forming apparatus. In particular, the present invention relates to an endless belt or film driving mechanism that is capable of suppressing an uneven contact between the endless belt and a tension applying member that stretches the endless belt around a plurality of belt to winding rollers.

2. Discussion of the Background

Conventional endless belt winding mechanisms include a pair of belt winding rollers for winding and rotating an endless belt. FIG. 10 shows an endless belt winding mechanism used for a film type heating device as a fixing device which applies heat to a sheet. This type of device is described in Japanese Patent Application Laid Open No. 08-334997. The fixing device includes a fixing roller 101 and a heating roller 102 that cooperatively wind an endless belt 100. The fixing device further includes a pressure roller 110 driven by the fixing roller 101 and a spring 111 for applying a bias to the pressure roller 110 so that the pressure roller pressure contacts the fixing roller 101. The heating roller 102 includes a heater 108 therein and is biased by a compressing spring 107 in a direction opposite the fixing roller 101.

The compressing spring 107 applies tension to the endless belt 100. In this example, a driving motor drives the fixing roller 101 in a predetermined direction as illustrated by the arrow 500. The fixing roller 101 rotates the endless belt 100 in a same direction. The endless belt 100 then rotates both the heating roller 102 and the pressure roller 103 in predetermined directions.

The heating roller 102 preheats the endless belt 100 at a position upstream of a nip portion 112 between the fixing roller 101 and the pressure roller 103. A toner image carried on a sheet S is fixed by the heat of the endless belt 100 and the pressure applied by the pressure roller 103 to the endless belt 100 when the sheet S passes through the nip portion 112. The sheet S is then ejected onto a sheet ejecting-guide 106.

With the fixing device described above, a film surface-contacting member 104 is sometimes employed and pressure contacts the surface of the endless belt 100. A spring 113 biases the endless belt 100. The film surface-contacting member 104 functions as a cleaning device for removing debris such as paper powder, toner, etc. remaining on, and sticking to, the endless belt 100. The film surface-contacting member 104 also functions as a release agent applying member for applying a release agent such as silicon oil to the endless belt 100.

The release agent generally suppress a toner offeset when applied to the endless belt 100. Toner offset is sometimes created by a toner image if transferred to the endless belt 100. The fixing device is widely used, for example, in copiers, in laser beam printers (hereinafter referred to as LBPs), and in electrostatic printers. The fixing device is used for permanently fixing a toner image onto a toner carrying medium as mentioned above, and for changing a characteristic of a surface of a toner carrying medium. The fixing device is also used for provisionally fixing a toner image onto a sheet by applying heat to the sheet.

The endless belt 100 tends to shift to either one side or both sides thereof during its transportation. A pair of belt winding rollers creates the belt shift due to the twisting positional relation of the endless belt 100. However, it is generally difficult to accurately dispose the pair of belt winding rollers in parallel.

As another device for avoiding the shift, a belt shift detecting member for detecting a shift of an endless belt is used to suppress the shift within a predetermined allowable range. As illustrated in FIG. 10, the belt shift detecting member includes a belt shift detecting ring 109 coaxially mounted on a shaft with one of belt winding rollers. The side face of the shift detecting ring 109 contacts a side face of the belt winding roller. The belt shift detecting ring 109 freely rotates around its axis independent from the belt winding roller with which the shift detecting ring 109 is coaxially mounted. The belt winding roller may swing around one of its ends by raising or lowering its other end.

The belt shift detecting member further includes a roller end moving device for moving an end of the belt winding roller downwardly, for example. The belt shift detecting ring 109 receives a torque when the endless belt 100 shifts and overlies its surface. The roller end moving device converts the rotational torque T1 into straight line movement, thereby moving one end of one of the belt winding rollers downwardly, for example. An example of the above-described belt shift detecting ring is described in the Japanese Patent Application Laid Open No. 08-314299.

To return the end of the belt winding roller to be moved, a force f2 is generally always applied upwardly to the end of the belt winding member, for example, the heating roller 102, by a bias applying member. The force f2 is applied in a direction opposite to the direction in which the end of the belt winding member moves.

However, since a force f1 is applied downwardly to the endless belt 100 by the spring 113 through the film contacting member 104, it may cancel the force f2. As a result, the shift of the endless belt may not be corrected as well as expected. Further, oil may not evenly coat the endless belt if the film contacting member 104 is constituted by an oil coating roller. Further, the cleaning efficiency is inferior if the film contacting member 104 is constituted by a cleaning member. Thus, to overcome the above-mentioned problem, the force f2 is generally quite large.

Further, the endless belt 100 may sometimes change its tension and thereby create a wave changing its level during transportation. This occurs because the heating roller 102 is supported by a base flame via a supporting portion 108 movable toward an opposite direction of the fixing roller 101 due to a bias of the compression spring 107, and the film contacting member 104 is mounted on a body 1000. As a result, the distance between the heating roller 102 and the fixing roller 101 may vary, and the tension of the endless belt 100 varies correspondingly. Thus, unevenness of thickness of the oil coated on the endless belt, and inferior cleaning occurs in the above-mentioned device. Further, since the belt shift detecting ring rubs the endless belt, the endless belt is sometimes worn away.

Additional devices have been developed to avoid unnecessary shifts of the endless belt. As one example, a belt shift suppressing member is mounted either on a front surface or a rear surface of the endless belt. As another example, one end of one of the belt winding rollers for winding an endless belt therearound swings around its other end by moving the end in a direction opposite to another belt winding roller using an electromagnet close/open device such as a clutch and a solenoid.

As yet another example, a pair of circular plate stoppers for stopping belt shift may be attached respectively to both side surfaces of the belt winding roller. Further, as described both in the Japanese Utility Model Patent Application Laid Open No. 05-14046 and the Japanese Patent Application Laid Open No. 04-121337, a reinforcing member for reinforcing the strength of the endless belt may be mounted on an edge of the endless belt. However, this belt shift suppressing member may peel off of the endless belt during operation. Moreover, the above-mentioned endless belt climbs over the circular plate stoppers when a large shifting force is applied thereto. Further, the endless belt may buckle, and the circular plate stoppers may damage the edge of the endless belt when a large shifting force is applied the endless belt.

SUMMARY OF THE INVENTION

Accordingly, an object of the present invention is to provide a new and improved endless belt driving apparatus.

This and other objects are achieved by a method and apparatus in which an endless belt driving apparatus includes a pair of belt winding rollers for winding an endless belt, and a tension applying device for applying tension to the endless belt which is substantially supported by the belt winding rollers.

In another embodiment, the endless belt driving apparatus further includes a belt shift suppressing device for suppressing a belt shift in a predetermined range. The belt shift suppressing device may include a belt shift detecting roller disposed beside one of the belt winding rollers, which is rotatably mounted on a shaft of one of the belt winding rollers. The belt shift suppressing device may further include a roller end moving device for moving one end of one of the belt winding rollers around its other end by converting torque of the belt shift detecting roller. This torque is created when the belt overlies the surface of the belt shift detecting roller. The roller end moving device may include a wire to be wound with one end of the wire connected to the body of the image forming apparatus and its other end connected to a belt shift detecting roller.

In still another embodiment, the endless belt driving apparatus includes a tension applying member such as an oil applying member, a cleaning member, and a bias applying member for applying a predetermined tension to an endless belt by applying a bias thereto in a direction opposite to the moving direction of one end of the wire winding roller. A bracket of the wire winding roller may support the bias applying member.

In yet another embodiment, a belt contacting member such as a cleaning roller pressure contacts an endless belt at a portion adjacent to the belt winding roller not moved so that the belt contacting member does not interfere with the movement of the other belt winding roller.

In still yet another embodiment, a belt contacting member includes another endless belt driving device having a pair of belt winding rollers. Each one of belt winding rollers may contact each other via the endless belts. A heat applying device may be provided for applying heat to one of endless belts. A first fixing portion may be formed upstream of a contact portion between both belt winding rollers, and a second fixing portion is formed at the contact portion thereof. A sheet feeding device may be provided for feeding a sheet having a toner image thereon toward both the fixing portions.

In still another embodiment, a belt shift detecting roller is made of material softer than the endless belt.

In still another embodiment, a belt contacting member is constituted by a release agent applying roller for applying a release agent to an endless belt. The release agent applying roller has a width smaller than the endless belt and larger than an image area to be formed on a sheet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
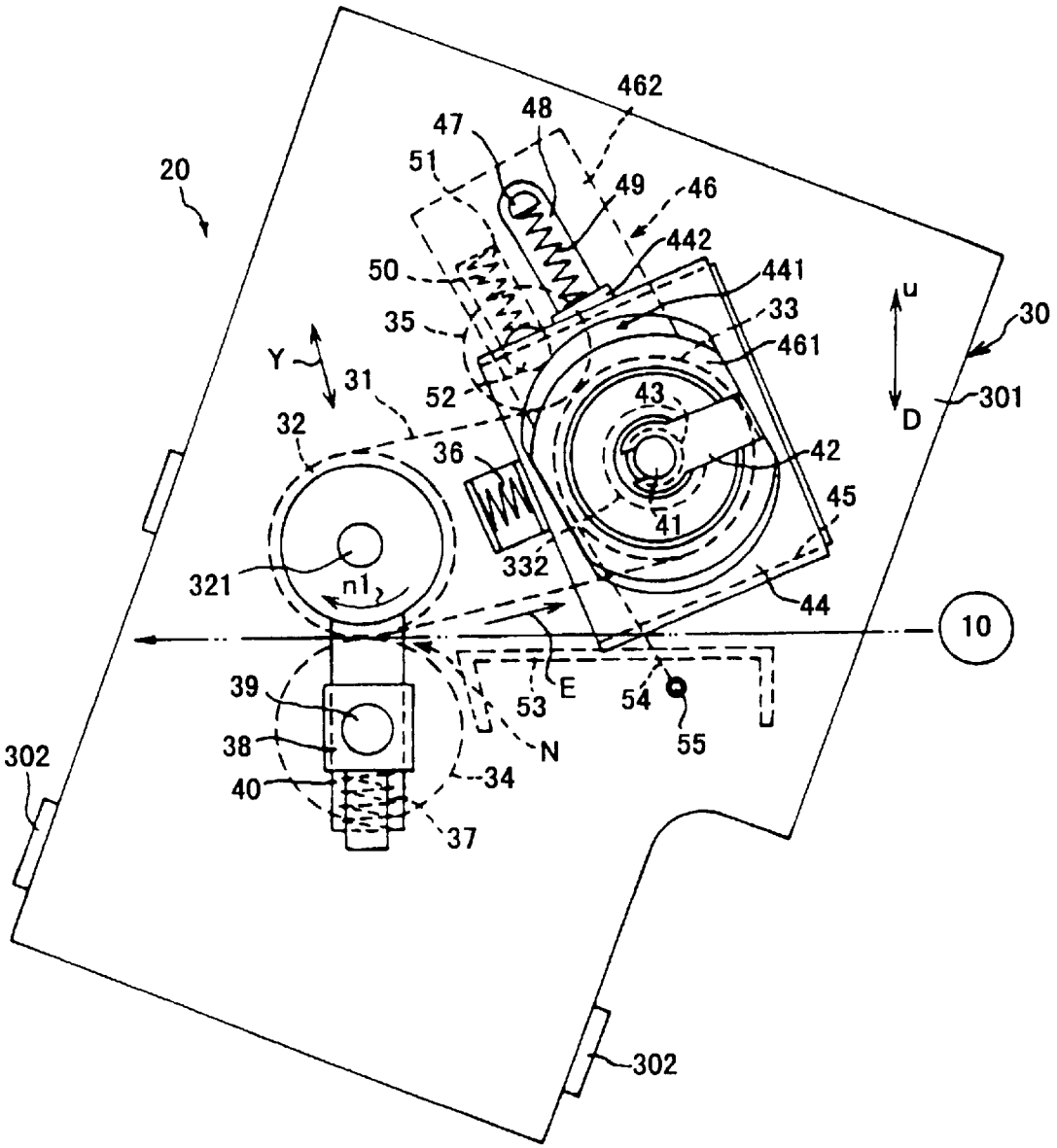
FIG. 1 is a sectional view that illustrates a heat type fixing apparatus incorporating the endless belt shift suppressing mechanism of the present invention.

Referring now to the drawings, wherein like reference numerals designate identical or corresponding parts throughout the several views, and more particularly to FIG. 1 thereof, there is shown a heat type fixing device 20 for use in an electrophotographic image forming apparatus (hereinafter referred to as a "copier") which employs an endless film driving mechanism.

Figure 9:
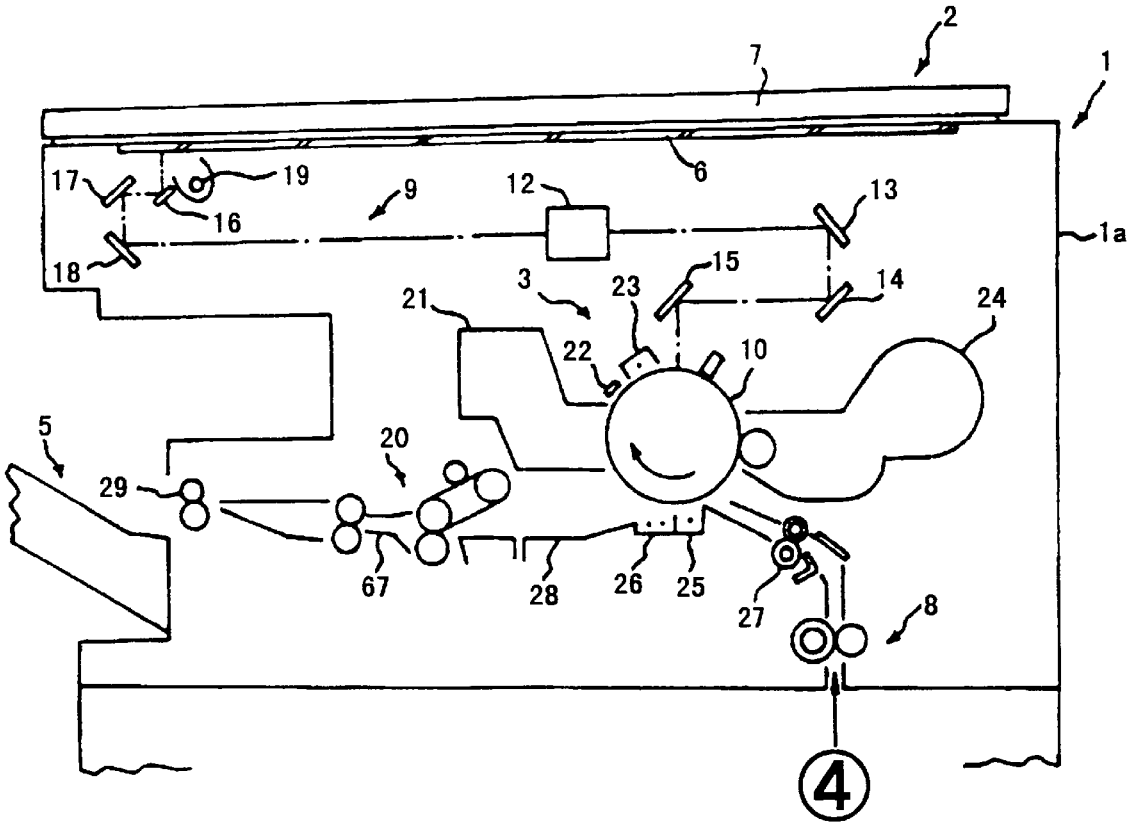
FIG. 9 is a partially cut away cross sectional view that illustrates an image forming apparatus having the heat type fixing device of the present invention.
Figure 10:
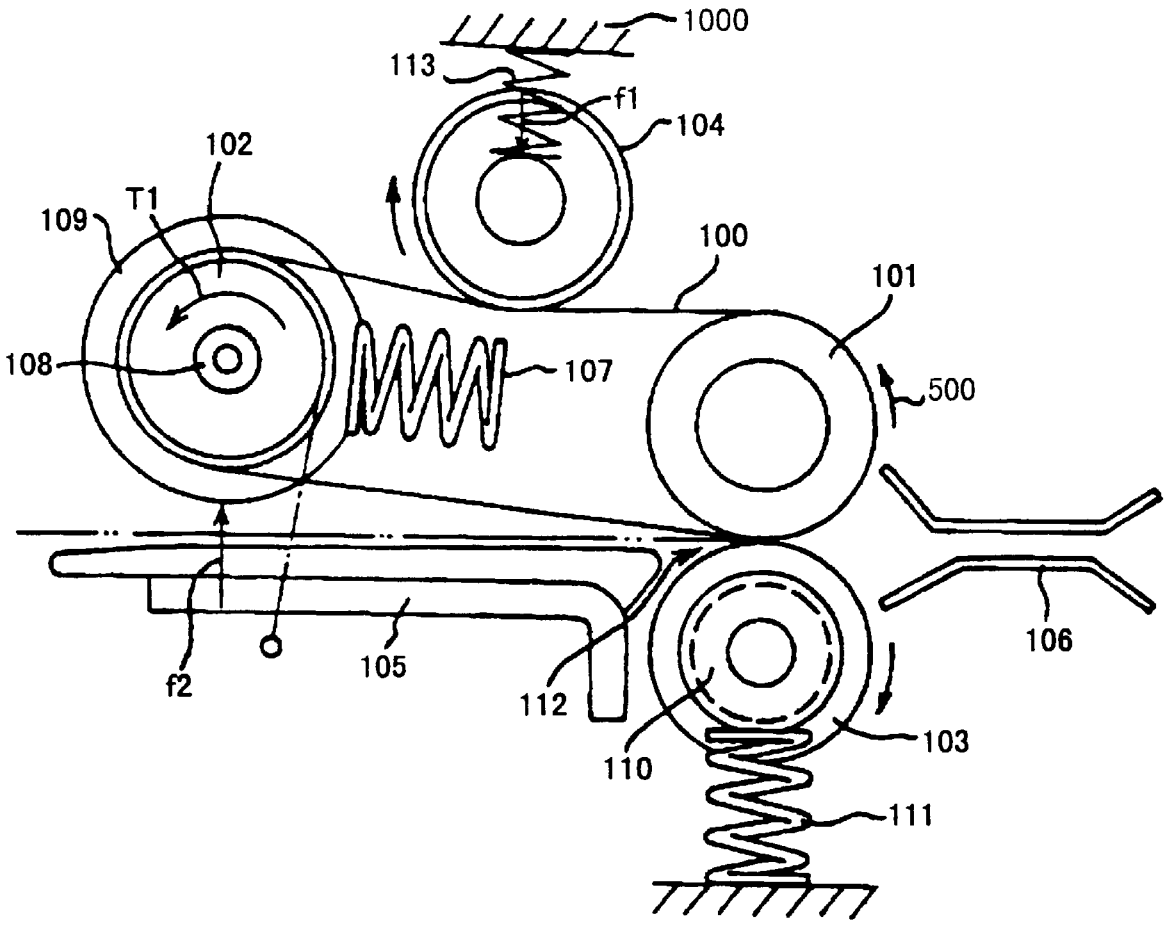
Fig. 10 (PRIOR ART)
FIG. 10 is a schematic cross-sectional view that illustrates a conventional heat type fixing device.

A copier 1, including the endless film driving mechanism, is illustrated in FIG. 9. As shown in FIG. 9, the copier 1 includes a document setting section 2 at an upper side of a body 1*a* and an image forming section 3 disposed below the document setting section 2. The copier 1 further includes a sheet feeding section having a plurality of sheet cassettes below the image forming section 3, and a sheet transporting section 8 for transporting the sheet P as a printing medium contained in the cassettes.

The copier 1 further includes a sheet ejecting section 5 disposed substantially at a side of the image forming section 3, and a controller for controlling the operation of the copier 1. The document setting section 2 includes a contact glass 6 and a document cover plate 7. The image forming section 3 includes an exposing device 9 for exposing a surface of a photoconductive drum (hereinafter referred to as a "PC drum") 10 corresponding to an image of the document set on the document setting section 2. A light source 19 of the exposing device 9 irradiates the document with a light beam. The surface of the PC drum 10 is then exposed by the light beam after the light beam is reflected from the document and passes through mirrors 13, 14, 16, 17, 18 and 19 and through a lens 12. The above-mentioned exposing operation is executed by moving the light source 19 and the plurality of mirrors 16 through 18, respectively, in predetermined directions.

The image forming section 3 makes a copy of the document image using a conventional image forming process. The image forming section 3 further includes a discharge device 23 for discharging the PC drum 10, a developing device 24 for developing a latent image formed on the PC drum 10, and a transfer charger 25 for transferring a developed image onto a copysheet. The image forming section 3 also includes a separating charger 26 for separating the copysheet from the PC drum 10, a heat type fixing device 20 for fixing the toner image to the copysheet using heat, and a cleaning device 21 for cleaning the surface of the PC drum 10 after the transfer process. The image forming section 3 further includes a discharge lamp 22 for discharging the surface of the PC drum 10.

When the document is set on the document setting table and a copy start key is depressed by an operator, the PC drum 10 is driven in a predetermined direction by a driving device and the surface thereof is evenly discharged with a charge by the discharge device 23. The light beam reflected from the document then exposes the surface so that a latent image is formed thereon. The developing device 20 develops the latent image so that a toner image is obtained. Copysheets S are fed one by one from the sheet feeding section 4 toward a registration roller 27 and are stopped at the registration roller 27. The sheet S is fed again by the registration roller 27 synchronously with the toner image carried on the PC drum 10.

The copysheet S receives the toner image from the PC drum 10 at a transfer station between the PC drum 10, the transfer charger 25, and the separating charger 26, since both chargers 25 and 26 function during a toner transfer process. A portion of toner remaining on the surface of the PC drum 10 after the toner transfer process is removed by the cleaning device 21 so that the next image formation can be executed on the surface. The copysheet S carrying the toner image is fed through the guide 28 toward the heat type fixing device 20. The copysheet is then fixed by the heat type fixing device 20 and ejected by an ejecting roller 29 to an outside of the body la to be stacked on a sheet ejecting tray 5.

Hereinbelow, the heat type fixing device is explained with reference to FIGS. 1 through 6.

As illustrated in FIG. 1, the heat type fixing device 20 includes a fixing unit 30. The fixing unit 30 includes a fixing roller 32, a heating roller 33, a pressure roller 34, and a film-like endless belt 31 wound around both the fixing roller 32 and the heating roller 33. The fixing unit 30 further includes a tension roller 35 for applying tension to the endless belt 31 and coating the surface of the endless belt 31 with oil having a release character for suppressing the toner offset (e.g., silicon oil).

Figure 4:
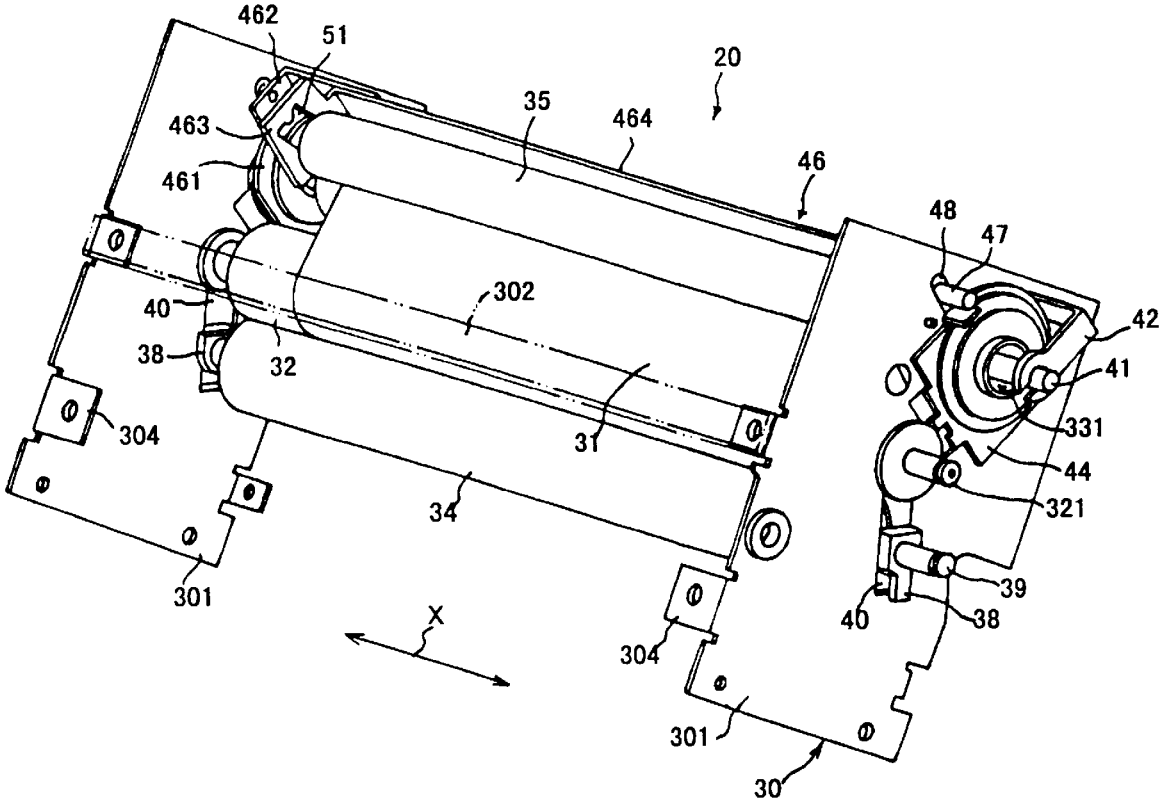
FIG. 4 is a perspective view that illustrates the heat type fixing apparatus illustrated in FIG. 1.

As illustrated in FIG. 4, the fixing unit 30 includes a pair of side plates 301 and connecting bars 302 (one of which is illustrated by the dotted line). As illustrated in FIG. 1, one of the side plates 301 slidably supports a movable frame 46. The movable frame 46 rotatably supports the oil coating roller 35. The endless belt 31 includes a thin film-like base layer made of nickel, for example, which has a thickness of about 100 $\mu$m. The endless belt 31 further includes a release layer made of silicon rubber, for example, which is formed on the base layer and has a thickness of about 200 $\mu$m.

Thus, the endless belt 31 has a high heat responsibility. The base can be made of polyimide resins having a thickness of from about 30 $\mu$m through 150 $\mu$m depending on the bending character of the base. A pair of bearing members 322 rotatably support both ends of the central axis 321 of the fixing roller 32, respectively. A driving device drives the fixing roller 32 clockwise as illustrated by n1. The fixing roller 32 includes a metal core and a porous elastic member coated around the metal core. The porous elastic member has relatively small heat conductivity and an anti-heat characteristic.

The pressure roller 34 includes silicon rubber so that a copysheet carrying a fixed toner image thereon is smoothly ejected from a nip portion N between the pressure roller 34 and the endless belt 31. A fixing guide 53 is disposed below the endless belt 31 so that the copysheet S carrying the toner image not fixed thereon can proceed to the nip portion N without contacting the endless belt 31. A sheet ejecting guide 67 (FIG. 9) is disposed downstream of the nip portion N. A pair of pressure roller bearings 38 rotatably support the pressure roller 34. The pair of pressure roller bearings 38 is slidably supported by a long guide groove 40 formed on the side plate 301. The pressure roller bearings 3B are upwardly biased by a compressing spring 37. The compressing spring 37 has a side that contacts the lower edge of the long groove 40, thereby enabling the fixing roller 32 to fix a toner image with pressure.

Figure 3:
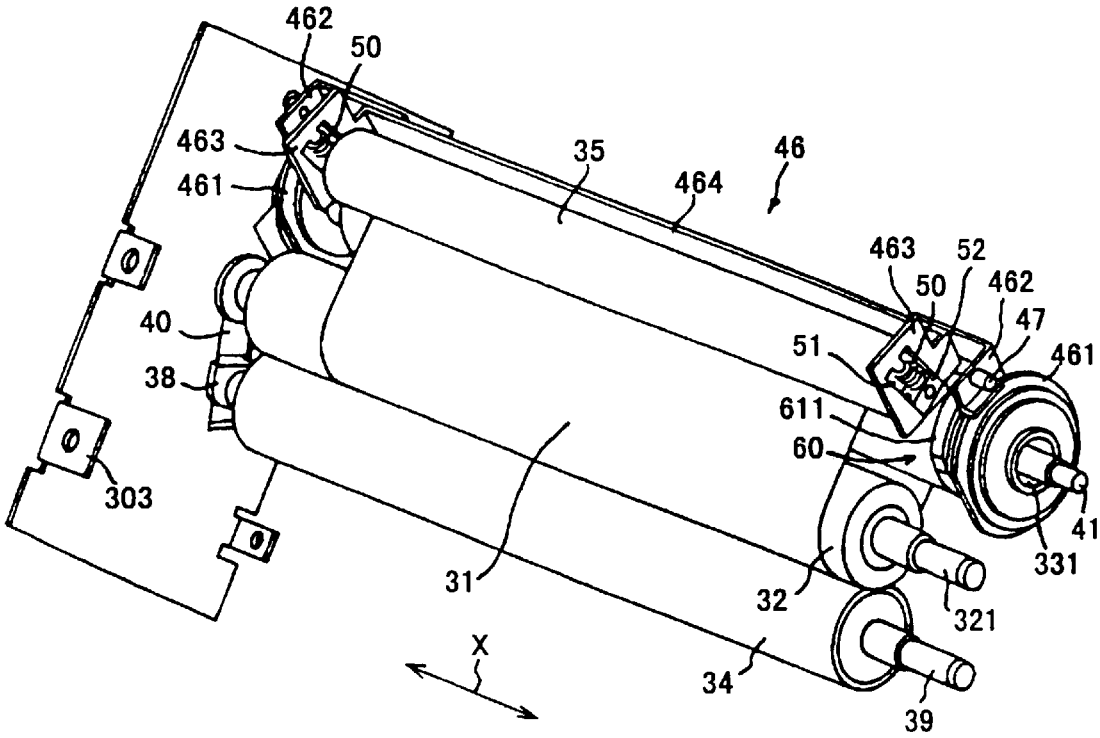
FIG. 3 is a perspective view of the heat type fixing apparatus illustrated in FIG. 1 when viewed after removing a front side plate of the heat type fixing apparatus.

As illustrated in FIG., 2, a pair of heat roller bearings 332 support both ends of the heat roller 33. The heat roller bearings 332 are mounted on a bearing support 461 (FIG. 3). As illustrated in FIG. 1, the bearing support 461 loosely fits in a vertical guide groove 441 formed on a slider 44 slidably supported by the side plate 301.

Figure 2:
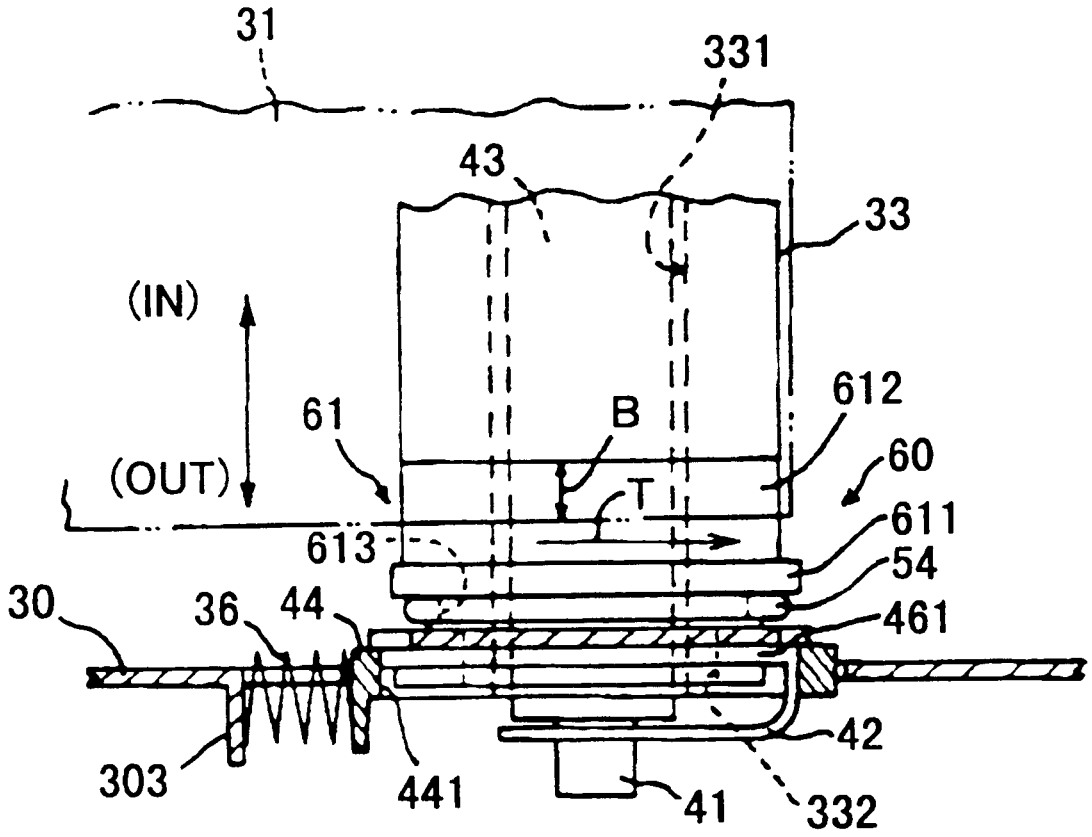
FIG. 2 is a schematic view that illustrates a front end portion of a heating roller of the heat type fixing apparatus illustrated in FIG. 1.

The slider 44 has a pair of overhanging upper and lower portions so that its cross section has a rectangular shape. Both the upper and lower edges slidably engage with a pair of straight guide rails 45 respectively mounted on the side plates 301. The slider 44 is biased by a slider spring 36 with a force P1. The slider spring 36 has an end connected with a flange 303 (FIG. 2). The force P1 is directed opposite the direction of the fixing roller 32 along the guide rail 45. Thus, a predetermined amount of tension corresponding to the force P1 is applied to the endless belt 31 wound by both the fixing roller 32 and the heat roller 33. Further, the bearing support portion 461 loosely fits into the substantially vertical guide 441 and slidably moves both upwardly and downwardly. The bearing support 461 is connected with the movable frame 46 and moves with the movable frame 46.

As illustrated in FIG. 3, the movable frame 46 includes a pair of the bearing supports 461 as mentioned above, a pair of overhanging portions 462 and a long plate-like portion 464 for connecting both of the overhanging portions 462. The movable frame 46 further includes a pair of roller receiving portions 463 positioned at an inner side of, and in parallel to, the overhanging portions 462. The roller receiving portions 463 protrude from the long plate-like portion 467. The overhanging portions 462 have a guide pin 47 protruding toward the side plate 301.

As illustrated in FIG. 1, the guide pin 47 loosely fits into the vertical groove 48 of the side plate 301 to slidably move up and down. The width of the vertical groove 48 is larger in size than the largest diameter of the guide pin 47 by a predetermined amount to make a space between the sides of the vertical groove 48 and the side plate 301. Thus, the guide pin 47 and the movable frame 46 move slightly in the direction E (substantially horizontally) with the slider 44. In this manner, an interference between the vertical groove 48 and the guide pin 47 can be avoided. The slight movement may occur, for example, when the heat roller starts its rotation during a transition period.

As illustrated in FIG. 1, the slider 44 includes a spring receiving flange 442 at its uppermost end. A roller moving spring 49 is set between the spring receiving flange 442 and the guide pin 47. The roller moving spring 49 is compressed to function to bias a belt winding member as explained below in greater detail. Thus, the movable frame 46 on the slider 44 can move slightly in the direction E when the slider 44 moves slightly in the direction in which the slider 44 is biased by the sliding spring 36. Further, the moveable frame 46 on the slider 44 can move vertically along the vertical guide groove 441 (i.e., direction Y) biased by the roller moving spring 49.

Figure 8:
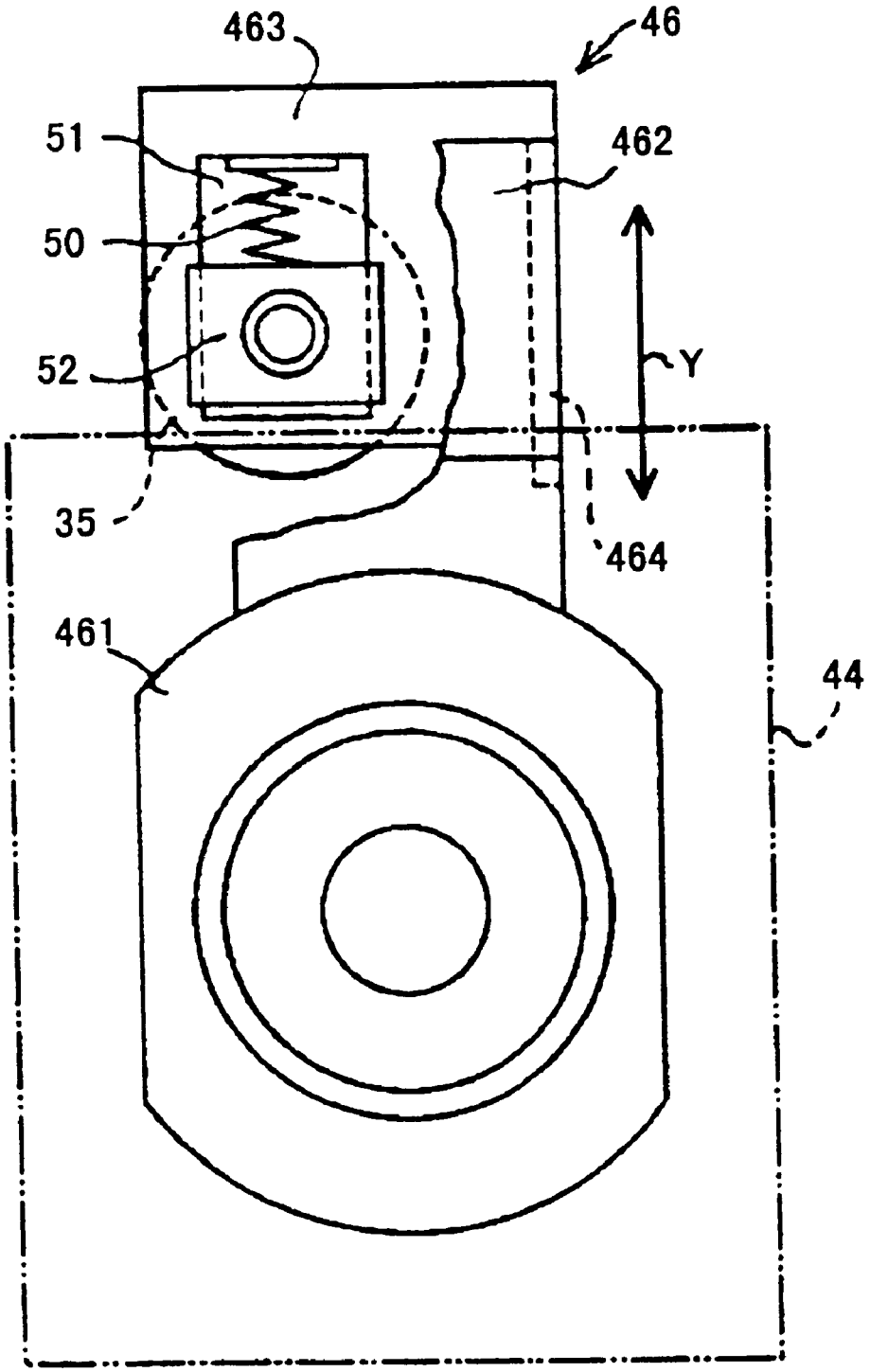
FIG. 8 is a partially cut away schematic cross sectional view that illustrates a principle part of the movable frame illustrated in FIG. 6.

As illustrated in FIGS. 3 and 8, the pair of roller receiving portions 463 respectively include vertical guide holes 51. As illustrated in FIG. 8, a contact roller support bearing 52 loosely fits into the vertical guide hole 51 to be slidably guided substantially up and down in the direction Y so that the film surface contact roller 35 selectively contacts and separates from the endless film belt 31. The contact roller support bearings 52 support an oil coating roller 35 therebetween.

A compression adjusting spring 50 is disposed between the upper end of the contact roller support bearing 52 and the upper wall of the vertical guide hole 51. The compression adjusting spring 50 applies a bias to the oil coating roller 35 so that the oil coating roller 35 pressure contacts the surface of the endless belt 31 elastically.

Since the pair of roller receiving portions 463 support the compression adjusting spring 50 as illustrated in FIG. 1, extra parts for supporting the compression adjusting spring 50 can be omitted. The compression force of the compression adjusting spring 50 may be determined such that the oil coating roller constantly and efficiently removes debris from the endless belt 31. The oil coating roller 35 includes a metal core and silicon rubber covering the metal core. The silicon rubber has an affinity for the silicon oil.

Figure 5:
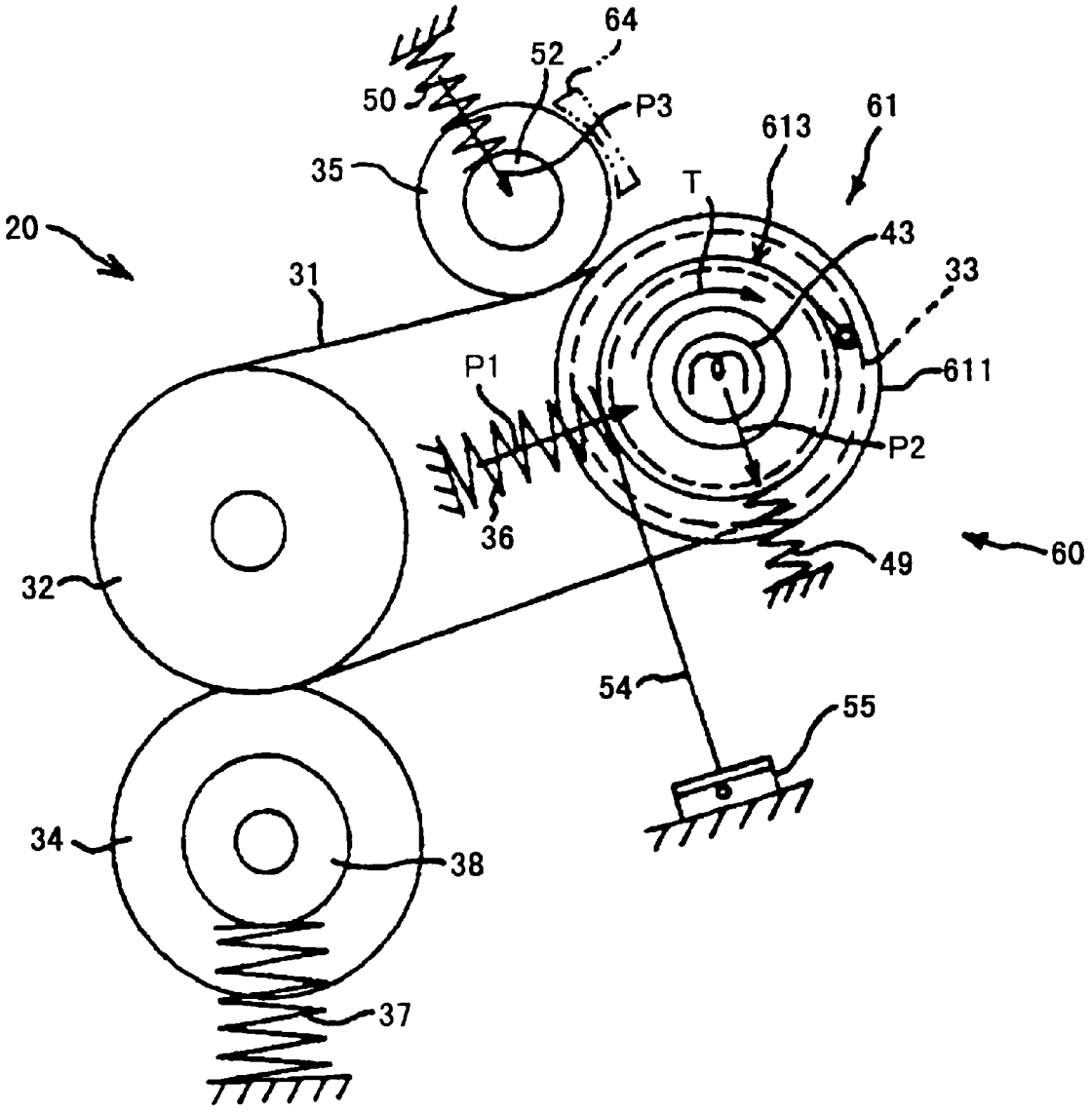
FIG. 5 is a schematic sectional view that illustrates the endless belt shift suppressing mechanism illustrated in FIG. 1.
Figure 6:
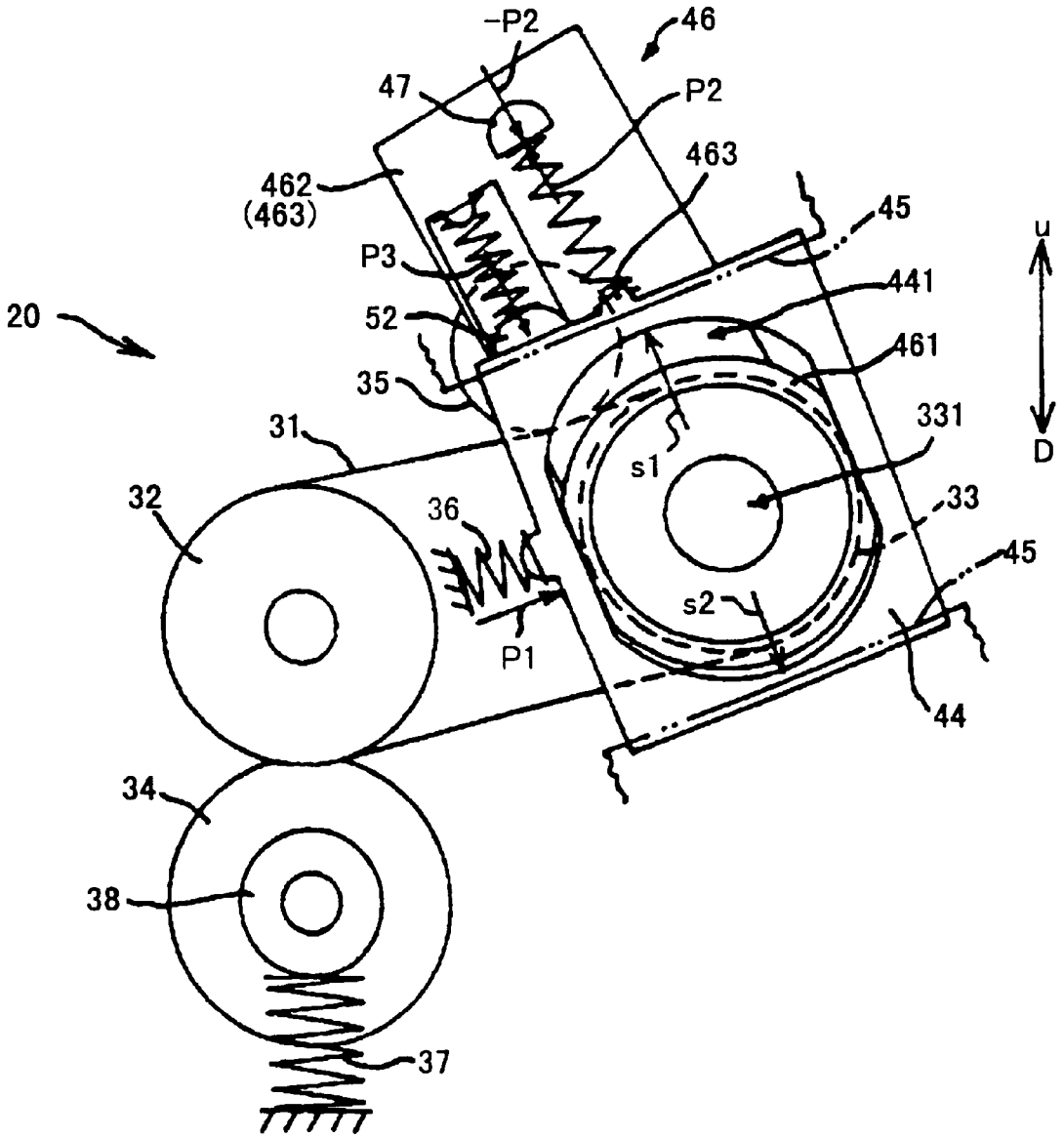
FIG. 6 is a schematic sectional view that illustrates a movable frame of the endless belt shift suppressing mechanism, which loosely supports the heating roller illustrated in FIG. 5.

As illustrated in FIGS. 2 and 5, the heating roller 33 supported by the pair of bearing support portions 461 of the movable frame 46 has a shift suppressing mechanism 60 at the end of its front side. As illustrated in FIGS. 2 and 5, the shift suppressing mechanism 60 includes a shift detecting ring 61 rotatably supported by a shaft at a front side of the heating roller 33. The shift detecting ring 61 detects shifts of the endless belt toward the front side.

The shift suppressing mechanism 60 further includes a roller end moving device. The roller end moving device includes a control wire 54 having an end connected with a body. The roller end moving device also includes a wire winding portion 613 formed with the shift detecting ring 61. The wire winding portion 613 has a wire connecting portion for connecting another end of the control wire 54 and winds the control wire 54 half way around, for example.

Thus, the roller end moving device lowers the end of the heating roller in a direction D when a side portion of the endless belt 31 shifts and overlies the shift detecting ring 61. This is due to a rotational torque T applied to the shift detecting ring 61 which is converted by the roller end moving device to a straight line motion by winding the control wire 54 around the wire winding portion 613.

A front side portion of the central shaft of the heating roller 33 concentrically supports the shift detecting ring 61 with the heating roller 33. The shift detecting ring 61 is disposed beside the heating roller 33 with its rear side surface slidably contacting the front side surface of the heating roller 33. The shift detecting ring 61 has substantially the same diameter as the heating roller 33. The shift detecting ring 61 further includes a stopper flange 611 extruding from its outer side for stopping an excessive shift of the endless belt 31.

A wire winding portion 613 is attached to the stopper flange 611 at an outer side thereof. The wire winding portion 613 has a ring-like groove for winding the control wire as illustrated in FIGS. 2 and 5. One end of the control wire 54 is connected with the wire connecting portion of the wire winding portion 613, and its another end is connected with the side plate 301.

A portion of the control wire between both ends is wound substantially halfway around the ring-like groove. The control wire 54 is flexible and is made of a material that may produce a relatively small distortion when pulled. As illustrated in FIGS. 1 and 5, the control wire 54 is wound in the same direction as the rotational torque T applied to the shift detecting ring 61. As illustrated in FIG. 5, an oil coating felt member 64 contacts the oil coating roller 35 supported by the movable frame 46 to apply oil (e.g., silicon oil) to the oil coating roller 35. The oil coating felt 64 may be detachably mounted on the movable frame 46 so that it can be easily exchanged.

The operation of the above-mentioned heat type fixing apparatus 20 will now be explained with reference to FIGS. 1, 2, 5 and 6.

As illustrated in FIG. 1, when image formation starts using a conventional image forming process, an endless belt 3 rotates clockwise as indicated by arrow n1. If the endless belt 31 shifts in a rear side direction IN (FIG. 2), the contact width of the endless belt 31 overlapping a surface of the belt shift detecting ring 61 becomes smaller. Thus, the conflicting force between the endless belt 31 and the belt shift detecting ring 61 is smaller, and accordingly, a rotational torque T applied to the belt shift detecting ring 61 is smaller.

As a result, a force P2 generated by the roller moving spring 49, which biases one end of the heating roller upwardly, exceeds a force -P lowering the one end of the heating roller, which is generated by converting the torque T. Thus, the front end of the heating roller 33 is raised along the vertical guide groove 441 and stops when it contacts the upper wall s1 of the vertical guide groove 441. The heating roller 33 swings about its rear when the front end raises in the direction U. Thus, the heating roller 33 twists relative to the fixing roller 32 and the pressure roller 34. Then the front side portion of the endless belt shifts to an upper side of the fixing roller 32 in the direction OUT. This is because the front side of the fixing roller rolls in the endless belt 31.

Then the amount of the overlapping width B of the endless belt 1 gradually increases, and the conflicting force and the rotational torque T correspondingly become larger. As a result, the lowering force -P gradually increases. When the lowering force -P becomes larger than the raising force of the roller moving spring 49, the wire winding portion 613 winds the control wire 54, causing the front end of the heating roller to lower in the direction D.

If the force -P continues to be larger than the force P, the bearing support portion 461 contacts the lowermost end wall s2 of the vertical guide groove 441. Thus, the heating roller 33 swings about its rear end by lowering the front end in the direction D. Thus, the heating roller 33 twists relative to the fixing roller 32 and the pressure roller 34. Then the rear side portion of the endless belt shifts to an upper side of the fixing roller 32 in the direction of the rear side IN.

The overlapping width B of the endless belt 31 gradually decreases, and accordingly, the conflicting force and the rotation torque T decreases. The force -P decreases corresponding to the decrease of the rotation torque T so that the force -P eventually becomes smaller than the force P2 of the roller moving spring 49. The control wire 54 wound around the wire winding portion 613 is unwound therefrom, and accordingly, the front end is lifted by the force of the roller moving spring 49 in the upper direction U. If the force P continues to be larger than the force -P, the bearing support portion 461 contacts the uppermost end wall s1 of the vertical guide groove 441. The endless belt 31 returns in the front side direction OUT.

Thus, the bearing support portion 461 may slide up and down along the vertical guide groove 441 between both the uppermost and lowermost end walls al and s2 of the vertical guide groove 441. The slider 44 and the bearing support portion 461 slightly slide horizontally in the direction opposite the fixing roller 32 along the guide rail 45 of the side plate 301 biased by the spring 36 by an amount of P1.

Further, since the movable frame 46 supports the oil coating roller 35 and the bearing support portion 461 which supports the heating roller 33, the positions of the oil coating roller 35 and the heating roller 33 do not change vertically or horizontally relative to each other. As a result, the contacting condition of the oil coating roller 35 and the tension of the endless belt 31 do not change which helps to prevent the formation of waves in the endless belt 31. Additionally, the cleaning of debris off of the endless belt 31 is prevented from becoming uneven.

Even if the movable frame 46 moves up and down, since a vertically positional relation between the heating roller 33 and the oil coating roller 35 does not change, the state of contact between the endless belt 31 and the oil coating roller 35 does not change.

Further, due to the reasons mentioned above, the lifting force P2 of the roller moving spring 49 may not be cancelled by the force applied to the oil coating roller 35 from the compression adjusting spring 50 (FIG. 5). Thus, a belt shift suppressing mechanism 60 may prevent the endless belt 31 from shifting outside of an allowable range. Further, the debris on the endless belt 31 can be cleaned by the oil coating roller 35 even during the operation of the belt shift suppressing mechanism 60.

An oil coating felt can be used for the oil coating roller 35 which directly contacts the surface of the endless belt 31. The oil coating felt can minimize a construction of the oil coating device.

Figure 7:
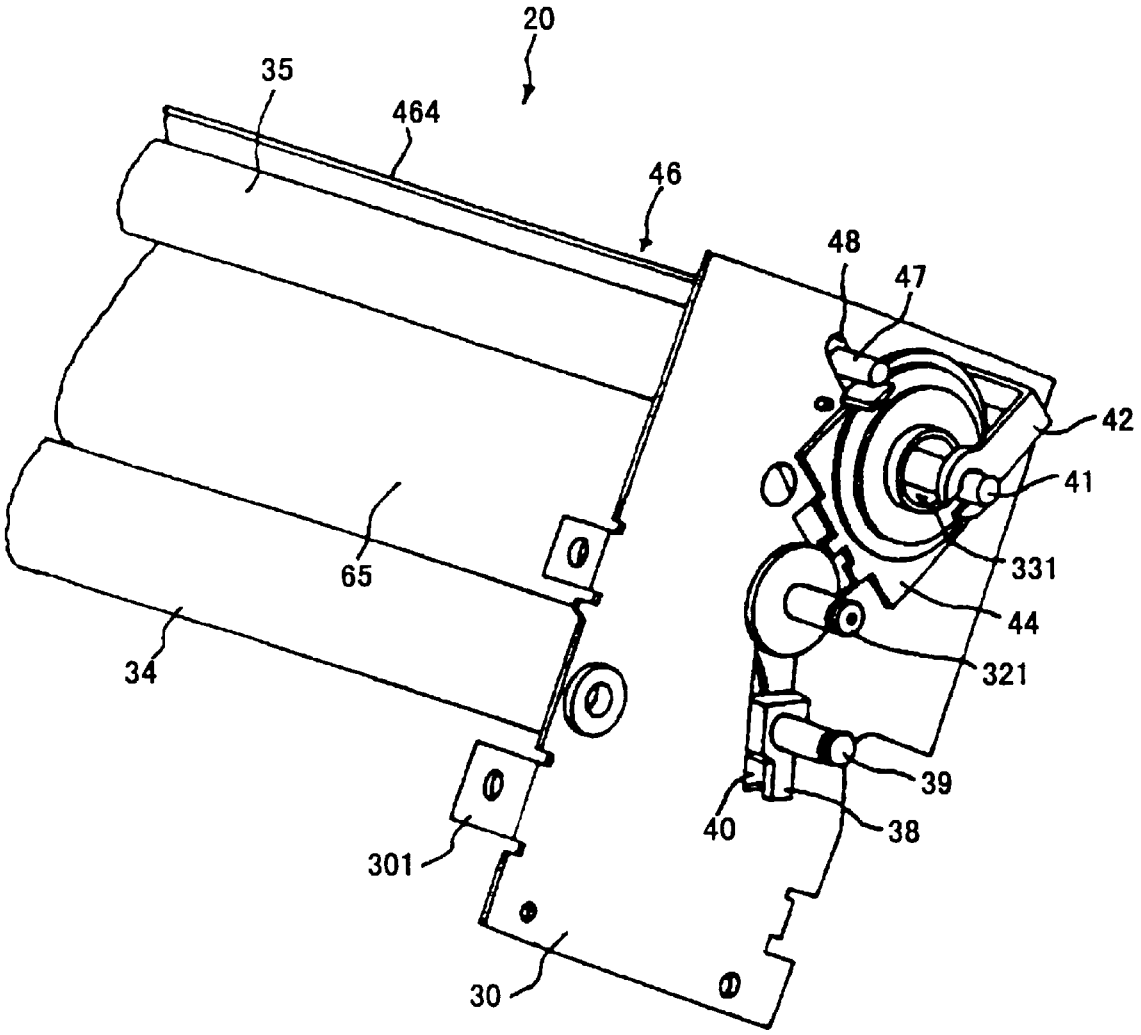
FIG. 7 is a schematic perspective view that illustrates another heat type fixing apparatus having a modified endless belt shift suppressing mechanism.

As illustrated in FIG. 7, a cleaning roller 35 can be used for the oil coating roller 35 and supported by a roller support bearing member 52. The roller support bearing member 52 can be slid in the same manner as illustrated in FIG. 8. The cleaning roller 35 may include a bar-like metal core and a layer of silicon rubber which covers the metal core. The surface of the silicon rubber may be roughed to efficiently remove debris on the surface of the endless belt 31 when contacting the surface. Further, a cleaning pad may be used for the cleaning roller 65.

Further, the endless belt 31 may generate heat itself instead of employing the heater in the heating roller 33 as illustrated in FIG. 1. Further, the above-mentioned belt shift suppressing mechanism may be used in a PC belt driving device for an image forming apparatus. In that case, the above-mentioned cleaning roller can be used as a film contacting member.

A second embodiment of the present invention will now be explained with reference to FIGS. 11 through 19.

Figure 11:
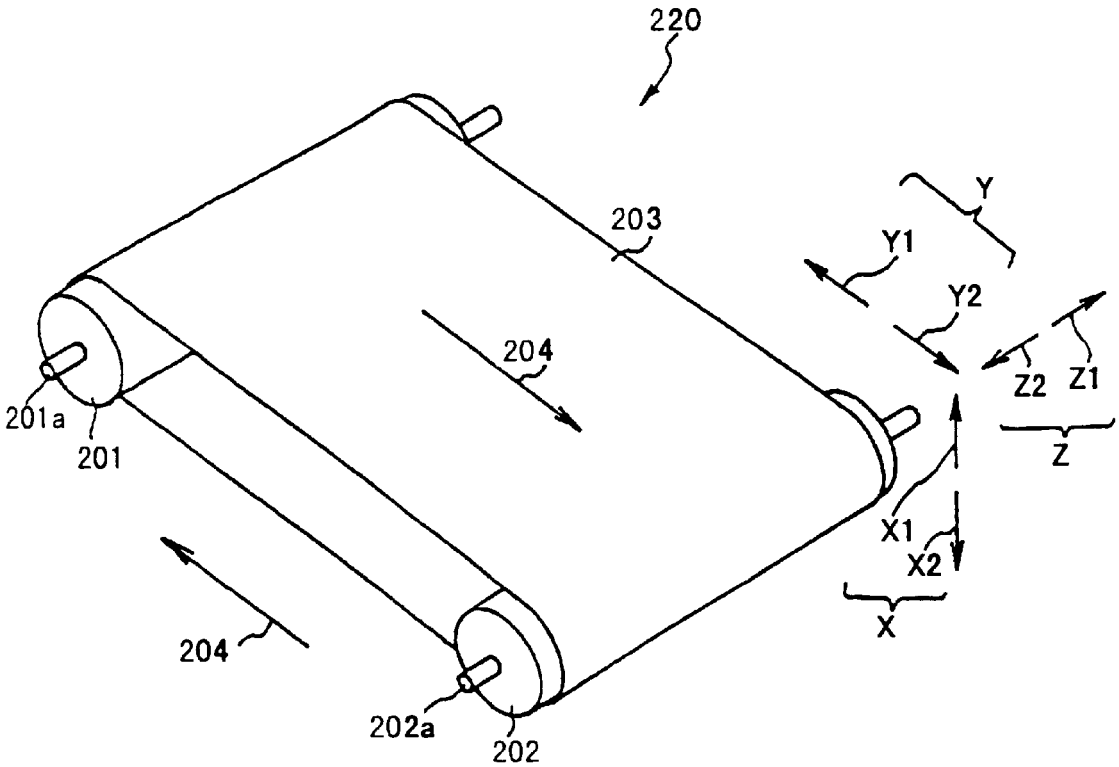
Fig. 11 (PRIOR ART)
FIG. 11 is a schematic perspective view of a conventional endless belt driving device, which explains moving directions of one end of a driven roller.
Figure 12:
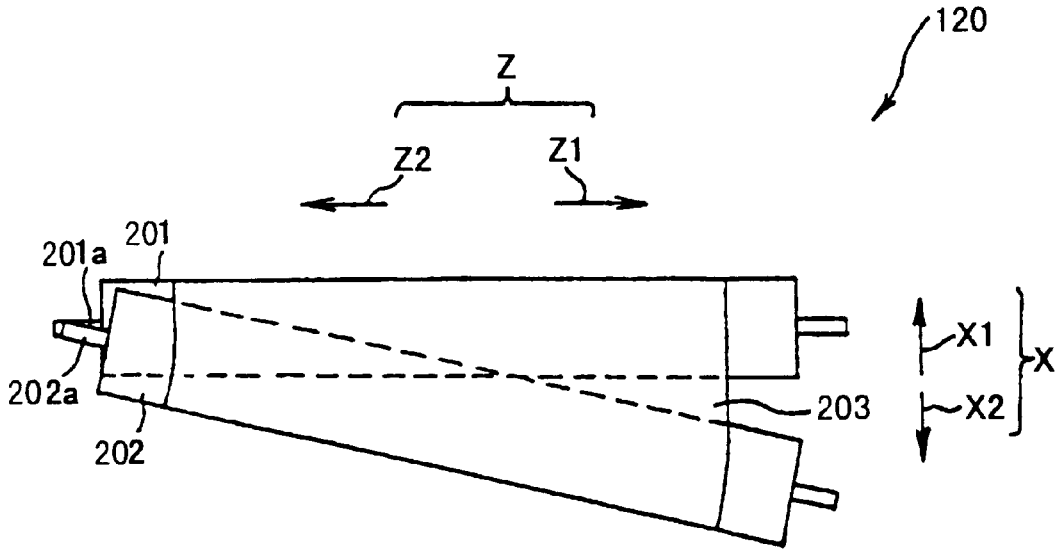
Fig. 12 (PRIOR ART)
FIG. 12 is a front side view of the belt driving device illustrated in FIG. 11, which illustrates a movement of a driven roller winding the endless belt in a direction X1.
Figure 13:
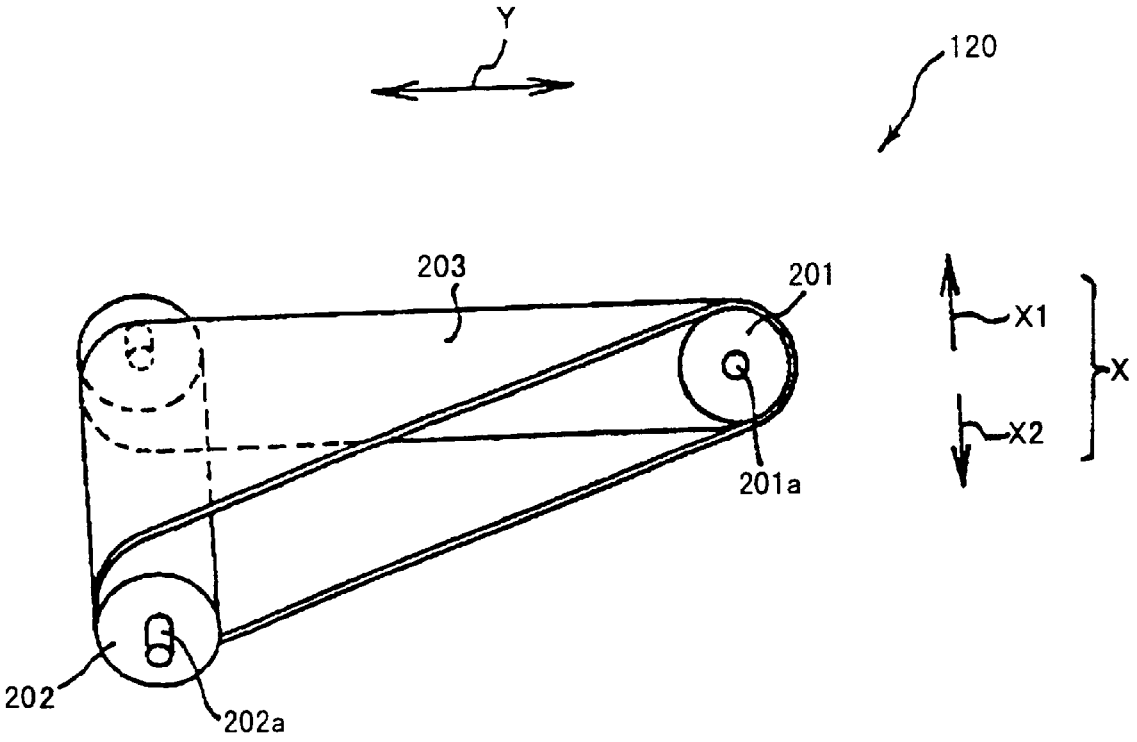
Fig. 13 (PRIOR ART)
FIG. 13 is side view of the belt driving device illustrated in FIG. 12.
Figure 14:
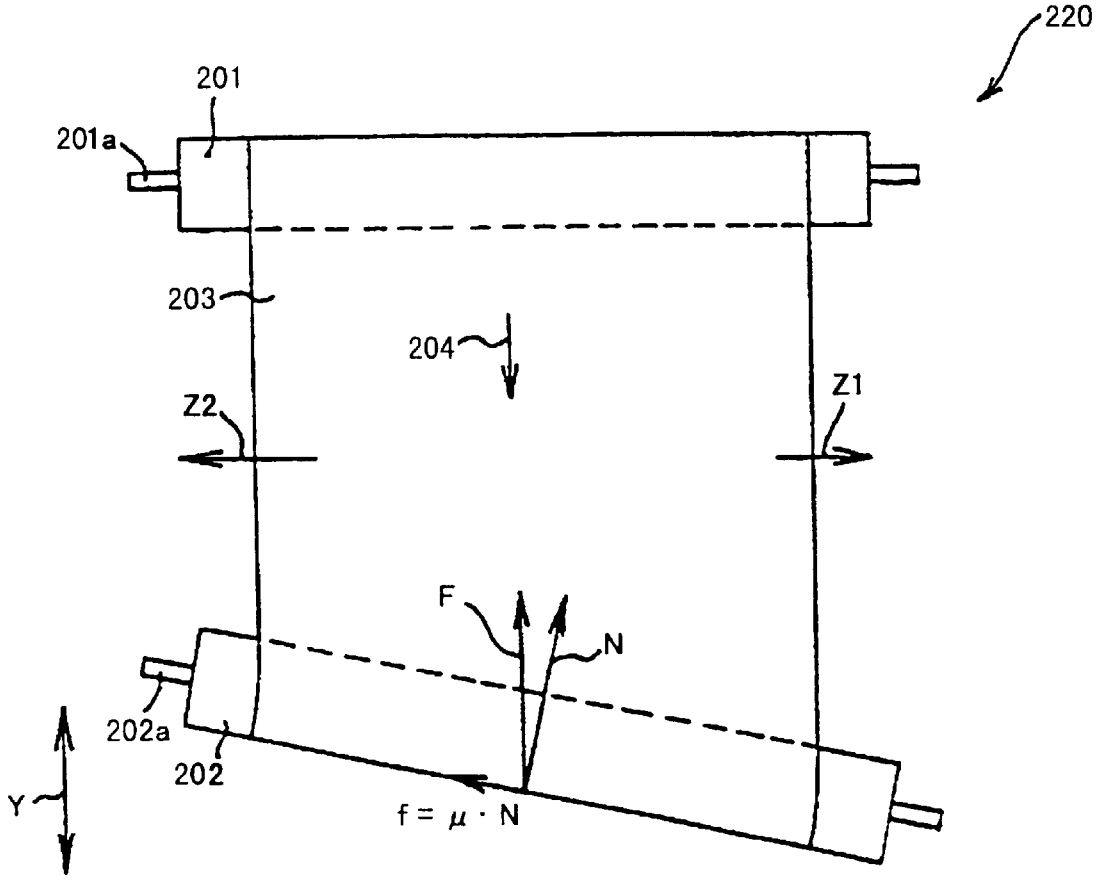
Fig. 14 (PRIOR ART)
FIG. 14 a plan view of the belt driving device illustrated in FIG. 11, which illustrates movement of a driven roller winding the endless belt in a direction Y2.

As illustrated in FIG. 11, an endless belt 203 is wound around both a driving roller 201 and a driven roller 202 in a manner similar to that described above for the first embodiment. One end of the driven roller 202 may move in directions X1 and X2.

Figure 16:
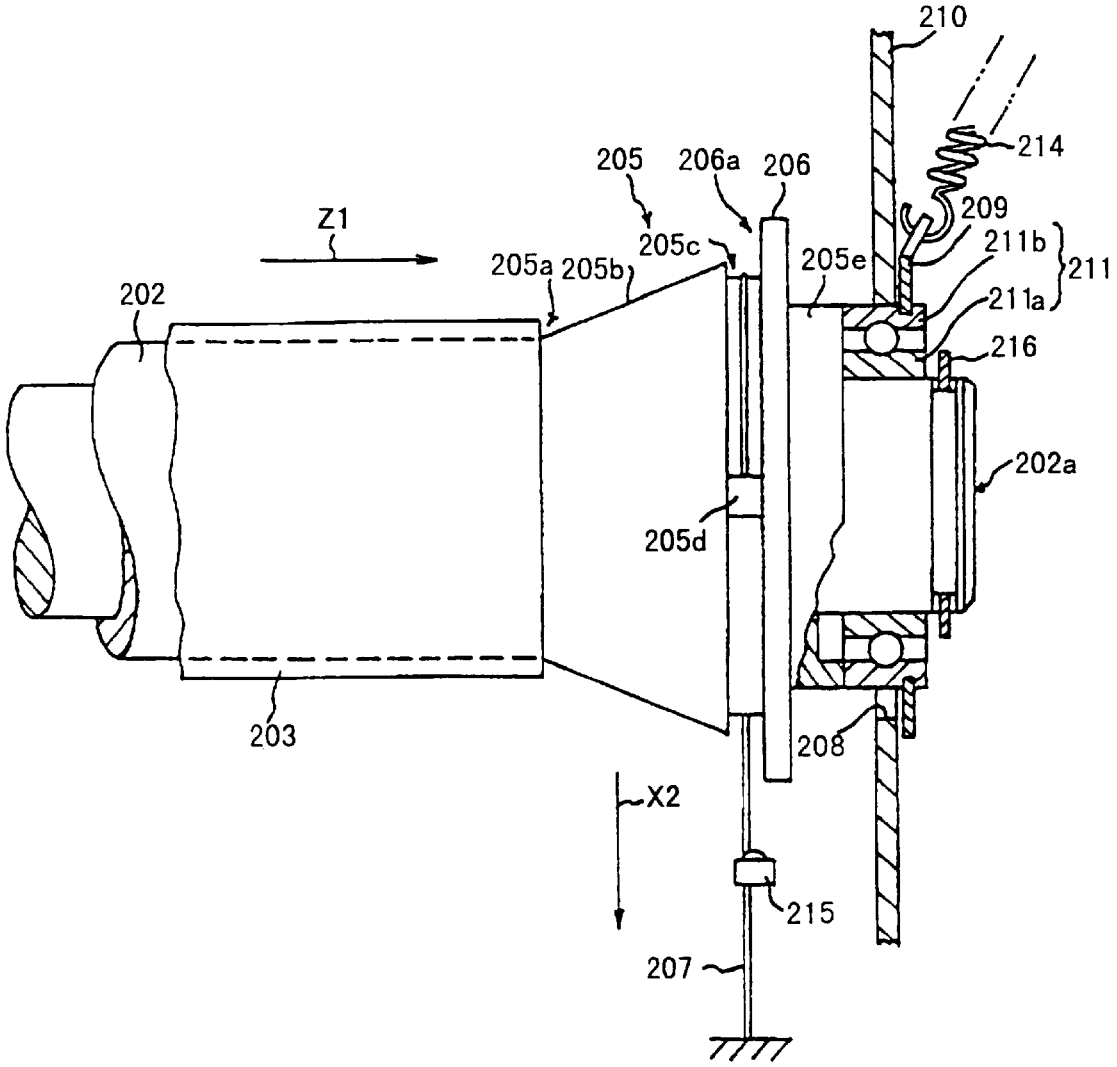
FIG. 16 is a front side view including a partially cut away view of a principal portion of a belt driving device of the present invention, which illustrates a belt shift suppressing member disposed at one end of a driven roller.

As illustrated in FIG. 16, a belt shift detecting cylinder 205 is coaxially mounted on a shaft 202*a* with a driven roller 202 at both of the outer sides of the driven roller 202. The belt shift detecting cylinder 205 may be driven by the endless belt 203 independently from the driven roller 202.

The belt shift detecting cylinder 205 has a circular conical frustum shape such that its diameter increases corresponding to a distance from the end of the driven roller 202 such that a 205*b* is formed. The belt shift detecting cylinder 205 rotates around the shaft 202*a*. The end 205*a* of the belt shift detecting cylinder 205 has a diameter substantially the same or slightly larger than that of the driven roller 202. The angle of the taper 205*a* is preferably from about 0 degrees to 6 degrees, depending on the susceptibility of the endless belt to buckling. A rotational torque may be applied to the belt shift detecting cylinder 205 when the endless belt shifts in a direction Z1 and overlies the taper 205*a*. The torque increases in proportion to the amount of the overlap.

The belt shift detecting cylinder 205 includes a stopper 206 disposed outside the taper portion 205*b* forming a step 206*a*. The stopper 206 has a diameter larger than that of the taper portion 205*c*. A groove 205*c* is formed between the taper portion 205*b* and the step 206*a*.

A wire 207 is provided such that one end of the wire 207 is connected to a connecting member 205*d* mounted on, and extruding from, the groove 205*c*. The other end thereof is connected to an image forming apparatus, for example. A belt type member can be used for the wire 207. A contact detecting sensor 215 such as a conventional photo-sensor is employed below and adjacent to the stopper 206 for detecting the edge of the endless belt 203.

Figure 17:
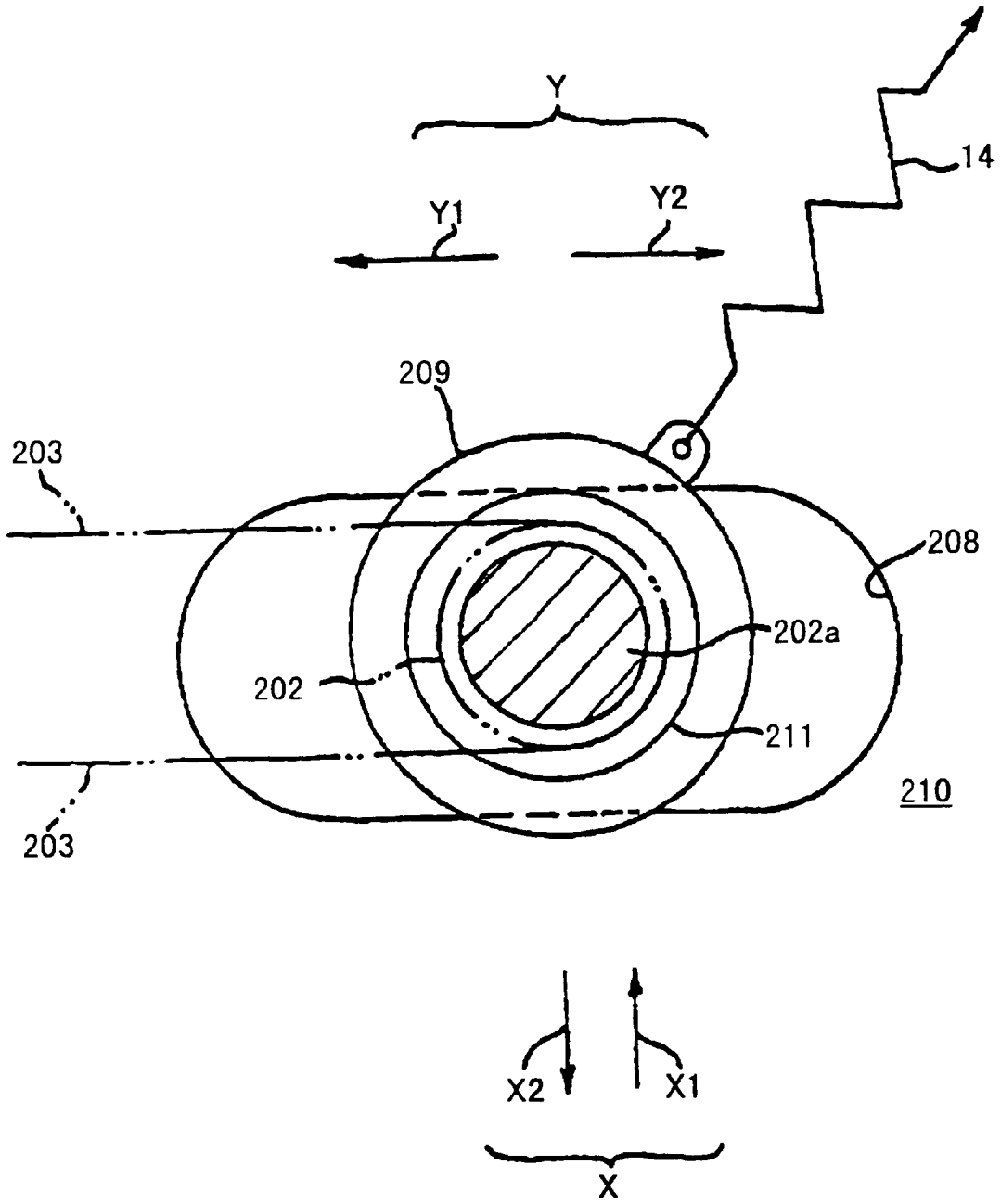
FIG. 17 is a schematic cross-sectional view of the driven roller illustrated in FIG. 16, which illustrates a supporting condition of the driven roller.

As illustrated in FIGS. 16 and 17, a bearing member 211 supports the shaft 202*a*, and loosely fits into a hole 208 of a side plate 210. The bearing member 211 includes an inner ring 211*a* and an outer ring 212*b*. A bearing support plate 209 is secured around the shaft 202*a* at an outer side of the side plate 210. The bearing member 211 is biased by a spring 214 through the bearing support plate 209. The shaft 202*a* engages with a C-ring stopper 216 at its endmost portion so that the shaft 202*a* is not removed. An E-ring like member can be used for the C-ring stopper 216.

The belt shift detecting member 205 further includes a spacing cylinder 205*e* having a predetermined width. The spacing cylinder 205*e* is disposed between the stopper 206 and the bearing 211 and is rotatable around the shaft 202*a*. The spacing cylinder 205*e* has a circular notch at its one side surface for preventing a contact with the inner ring 211*a* as illustrated by FIG. 16.

Thus, only the outer ring 211*b* contacts the spacing cylinder 215*e*. In this manner, a rotational force of the inner ring 211*a* is not transmitted to the belt shift detecting member 205, and accordingly, the belt shift detecting member 205 is kept apart from the bearing member 211. To omit the spacing cylinder, a side portion of the stopper 206 corresponding to the inner ring 211*a* can be cut away to form a notch.

A ball bearing can be used for the bearing member 211 to decrease its rotational torque as far as possible. Since tension is applied to the endless belt 203 when the driving roller rotates, and a rotational torque is correspondingly applied to the driven roller 202 by the endless belt 203, the driven roller 202 tends to swing in a direction X2 around the driving roller 201. However, the force required to move the driven roller 202 in the direction X2 is generally small due to a small torque of the ball bearing. Thus, the driven roller 202 avoids awkward rotation even if force is applied against the force of the bearing support spring 214.

Figure 18:
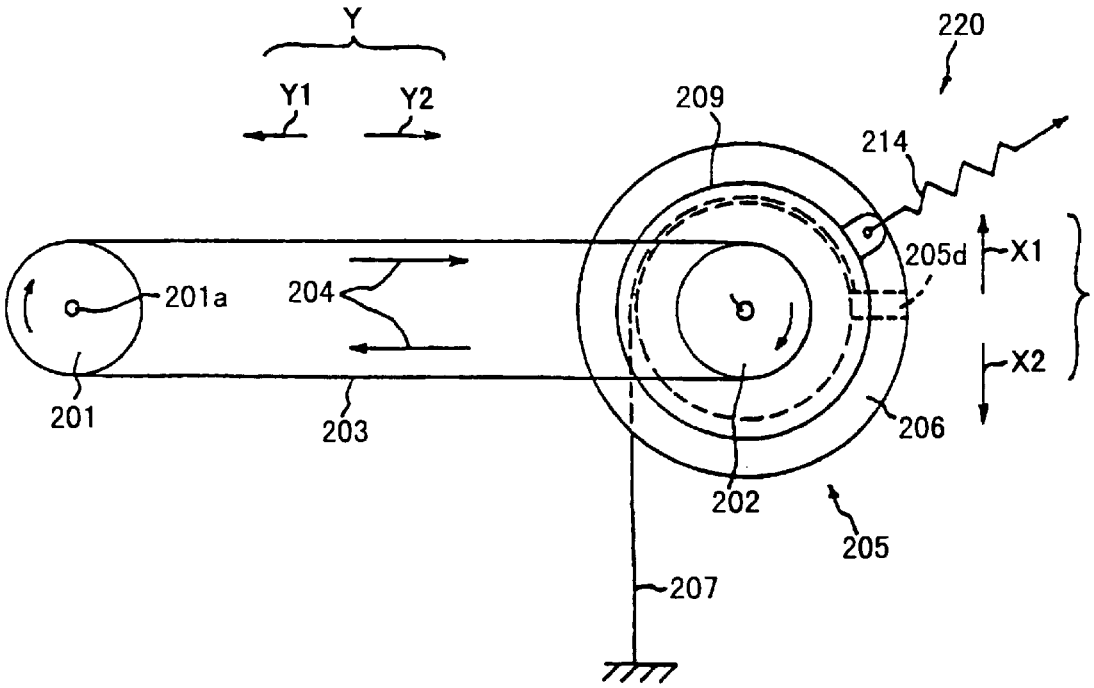
FIG. 18 is a schematic side view of the belt driving device having the belt shift suppressing member illustrated in FIG. 16, which illustrates a wire winding condition of the wire used in the belt shift suppressing member.

As illustrated in FIG. 17, the shaft 202*a* is biased in directions X1 and Y2 by the bearing support spring 214 via the bearing 211 and the bearing support 209. A component of the force in the direction X1 makes the bearing 211 contact an upper inner edge of the hole 208. Thus, both the driving roller 201 and the driven roller 202 are not positioned on a same plane. A component thereof makes a tension in the direction Y2 of the endless belt 203. As illustrated in FIG. 18, the wire member 207 extends substantially in parallel to a direction X, in which one end of the driven roller 202 moves.

Figure 21:
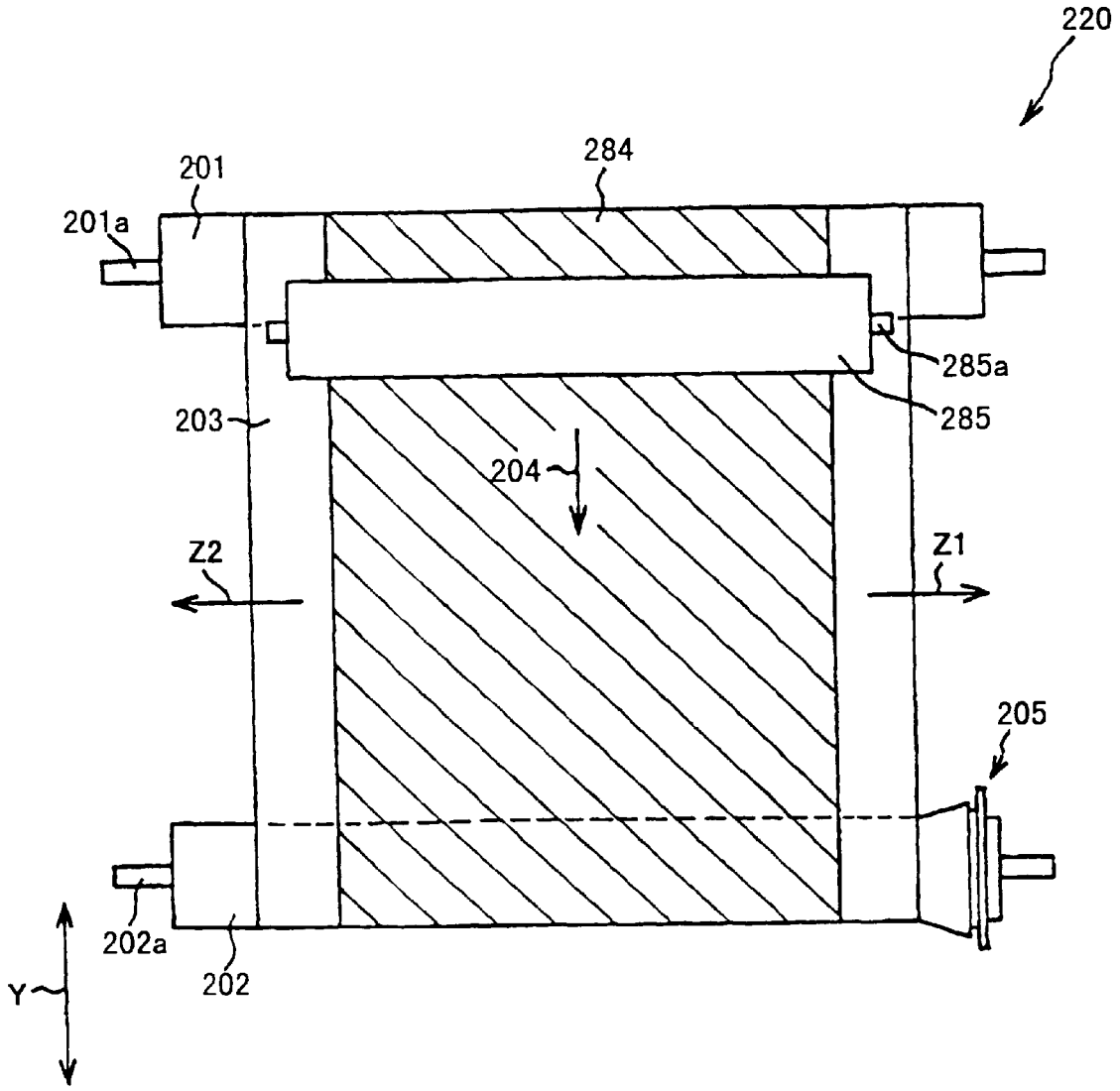
FIG. 21 is a plan view that illustrates a relation between an image area of a sheet to be transported by the endless belt and an area to which a release agent is applied.

The belt driving mechanism 220 can be applied to a fixing device or another image forming processing device of the image forming apparatus as explained later in greater detail (FIG. 21). The belt driving mechanism 220 may include a contacting member 285 pressure contacting the surface of the endless belt 203 with a predetermined pressure. The contacting member 285 may have a roller state shape and is rotatable around its shaft 285*a*. The contacting member 285 may be biased by a spring, and thereby driven by the endless belt 203. If the contacting member 285 contacts a portion of the endless belt 203 adjacent to the driven roller, it prevents movement at one end of the driven roller 202.

Figure 22:
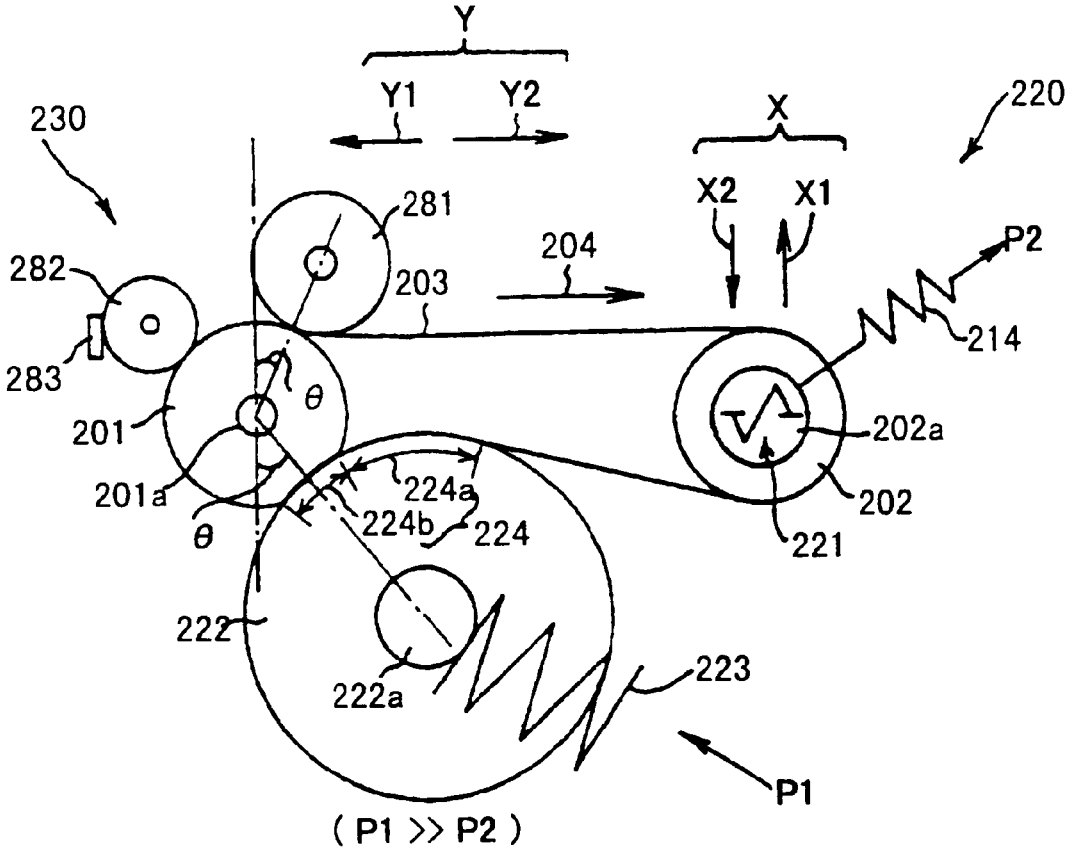
FIG. 22 is a schematic partial sectional view that illustrates one example of a fixing device employing the belt driving device of the present invention.

To move one of the driven rollers 202 against the contacting member 285, a large rotational torque must be applied to the belt shift detecting member 205. To avoid this problem, the contacting member 285 is positioned adjacent to the driving roller 201 as illustrated in FIG. 21. The position can be determined within a range, in which a contacting pressure of the contacting roller 285 does not substantially vary during rotation of the endless belt 203, and the contacting member 285 does not interfere with the vertical movement of one end of the driven roller 202. If the contacting member 285 is to be positioned on a belt contacting portion of the driving roller 201, in which the endless belt 203 is wound around the circumference of the driving roller 202, the contacting member 285 is preferably positioned in a manner such that a vertical line passing through the axis of the driving roller 201 passes through the axis of the contacting member 281 (corresponds to the contacting member 285) makes an angle θ less than about 30 degrees, as illustrated in FIG. 22.

The endless belt 203 includes a base member and a coat layer. The coat layer is not positioned at both end portions of the endless belt 203. If the coat layer is positioned at both end portions of the endless belt 203, the coat layer may be worn away by the belt shift detecting member 205, producing a powder. As a result, the powder may be scattered over and/or attracted to the various components of the copier.

The base member is made of nickel, for example. The coat layer is preferably made of silicon rubber, for example. Taking into account manufacturing costs and precision, other suitable metals such as stainless steel, iron, and polyimide resins (hereinafter referred to as "PI"), etc. may be used as desired. Anti-heat plastics such as fluorine plastic and fluorine rubber can be used for the silicon rubber of the coat layer which may be particularly desirable when the endless belt is used in a belt type fixing apparatus as explained below.

The belt shift detecting member 205 can be made of metal, for example. However, to avoid damage to the end portion of the endless belt 203—which generally occurs when the end contacts the belt shift detecting member 205—the belt shift detecting member 205 is preferably made of PI. Anti-heat engineering plastics such as polyether ether ketone (PEEK), polyphenylene sulfide resins (PPS), and polyacetal resins can be used as a coating layer for the PI base layer. If metal is used, aluminum and copper can be used as the PI base layer.

To avoid wear of the endless belt 203, the belt shift detecting member 205, as a counterpart of the endless belt 203, is preferably made of soft material so that it may be worn away earlier than the endless belt 203. Since the belt shift detecting member 205 is worn away earlier, a scoring phenomenon does not occur between the endless belt 203 and the belt shift detecting member 205, even if friction heat is excessively generated therebetween.

Further, the endless belt 203 is not worn away, even if a large tension is applied thereto by the friction. Additionally, the powder may function as a lubricant, extending the useful life of the endless belt 203.

Further, the base member is determined to have a predetermined hardness and a modulus of elasticity considering the scoring. Thus, since a frequency of exchange of the endless belt is relatively small due to a small level of the wear of the endless belt 203. Further, maintenance is easy and does not cost.

As mentioned above, each of material is preferably different from each other. Because, if a crystal form of metal used for both the base and the belt shift detecting member is almost same, the above-mentioned scoring may occur more frequently.

The above-mentioned belt shift suppressing device 205 operates almost in a manner similar to that described above for the first embodiment. However, a friction between the bearing member 211 and the belt shift detecting member 205 does not interfere with the rotation of the belt shift detecting member 205 since a sliding surface between the bearing member 211 and the spacing cylinder 205*c* has relatively a small area.

Further, since the contacting member 285 pressure contacts the endless belt 203 adjacent to the driving roller 201, it does not interfere with the movement of the end of the driven roller 202. Further, the contacting pressure of the contacting member 285 against the surface of the endless belt 203 does not vary during the movement of the end of the driven roller 202. Since working members, such as the endless belt 203, generally deteriorate over time, they have a limited useful life. Thus, the amount of shift of the endless belt 203 may become extremely large. However, the one end of the endless belt 203 collides with the stopper 206 and cannot get over the stopper 206. As a result, the deterioration of the endless belt 203 proceeds further.

To avoid such a problem, the contact detecting sensor 215 detects the end of the endless belt 203 at a position close to the stopper 206. The sensor 206 may include a light emitting diode.

Since the contact pressure of the contacting member against the endless belt does not vary, the lifetime of the endless belt may be extended. The driven roller 202 can be upwardly moved in the direction X1 instead of being downwardly moved in the direction X2. In such a case, the wire 207 may be wound in a direction opposite to that described above.

Figure 15:
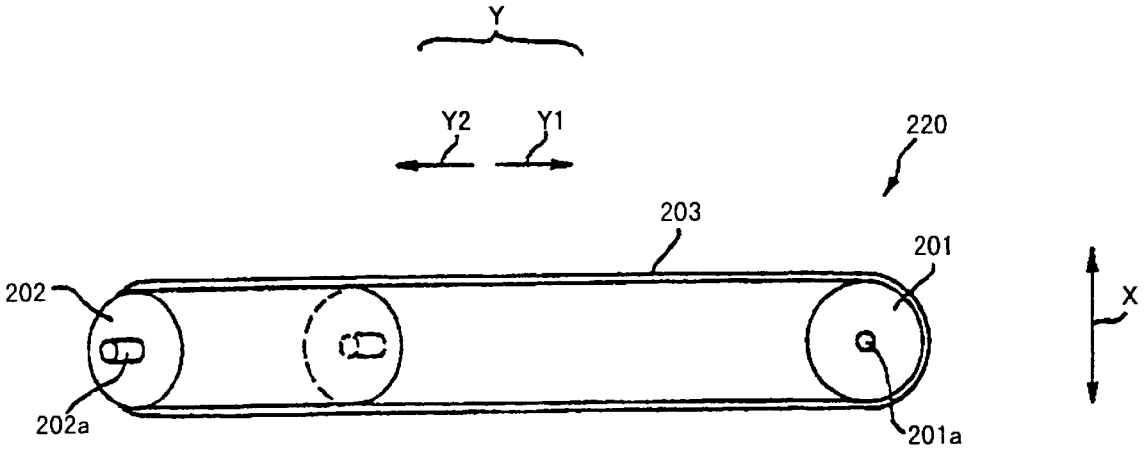
Fig. 15 (PRIOR ART)
FIG. 15 is a side view of the belt driving device illustrated in FIG. 14.

As illustrated in FIG. 15, one side of the driven roller 202 can be moved in a direction Y2 opposite to the driving roller 201 to suppress the belt shift. In this case, the wire 207 may be wound in a predetermined direction and extends in parallel with the plane of the endless belt 203.

Figure 23:
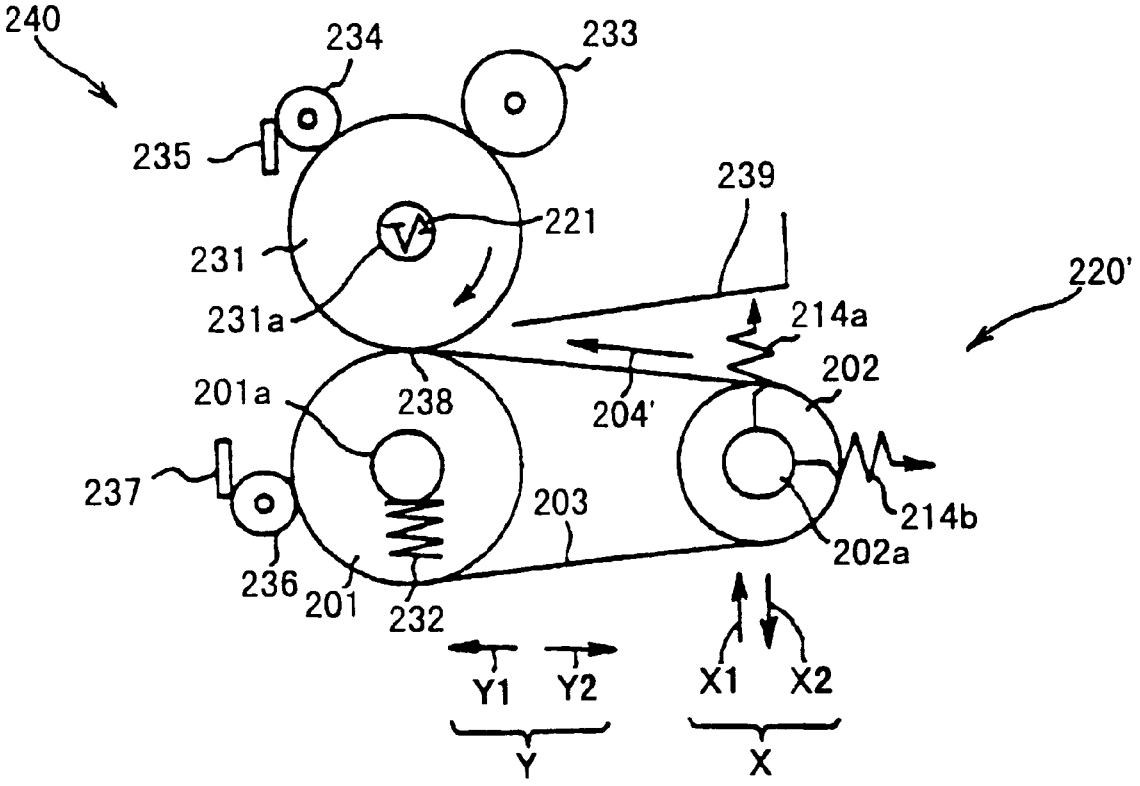
FIG. 23 is a schematic partial sectional view that illustrates another example of a fixing device employing the belt driving device of the present invention.
Figure 24:
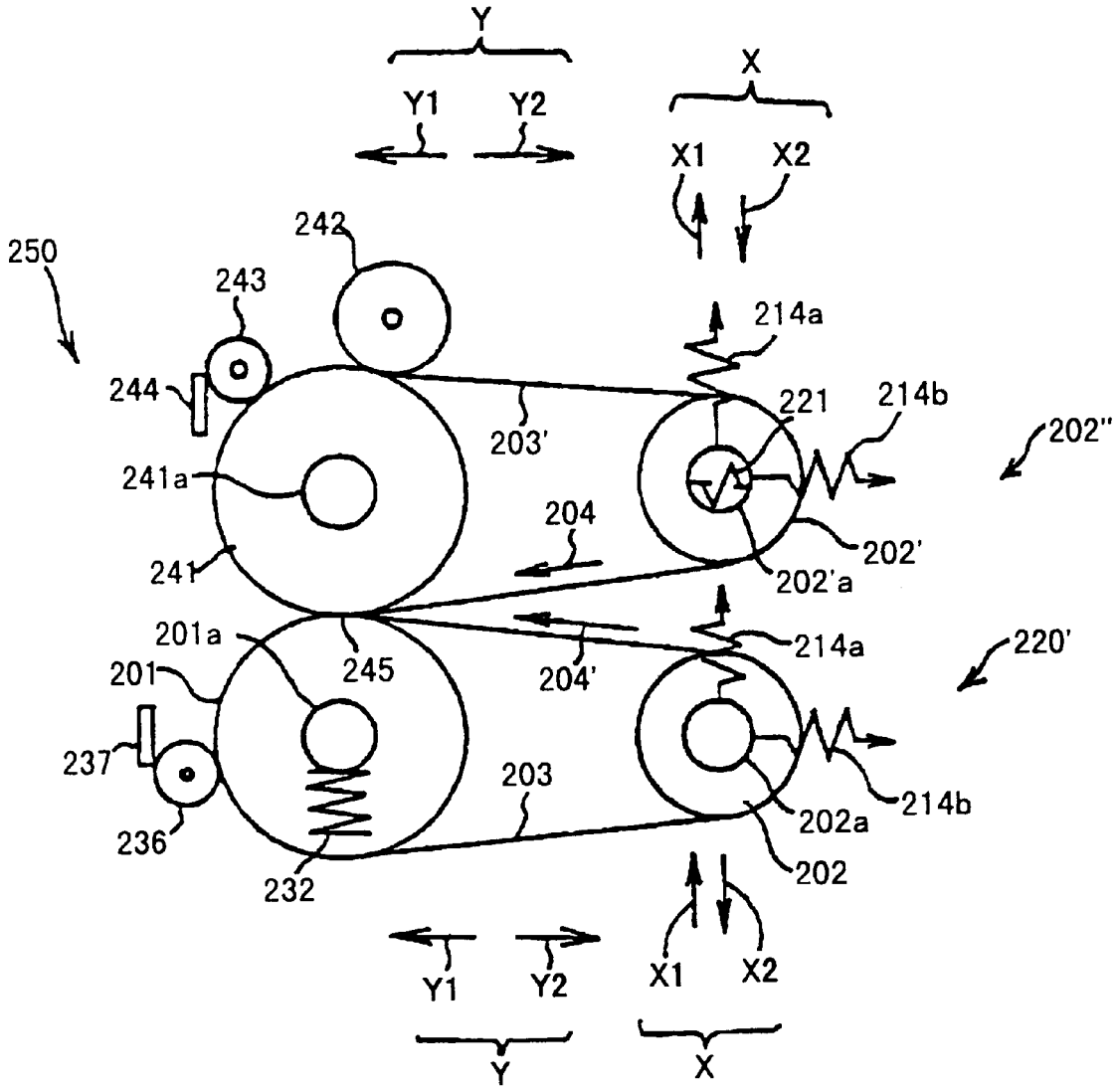
FIG. 24 is a schematic partial sectional view that illustrates still another example of a fixing device employing the belt driving device of the present invention.

A pair of springs may be connected to the driven roller 202, as illustrated in FIGS. 23 and 24. The belt shift detecting member illustrated in FIG. 16 can be supported by a different shaft than that of the driven roller if the endless belt 203 can overlap the same. Further, the belt shift detecting member does not have to be supported on the same axis with the driven roller 202, if the endless belt 203 can overlap the driven roller. In any case, the end of the belt shift detecting member that faces the side surface of the driven roller has a smaller diameter than the end facing away from the side surface of the driven roller. Further, the belt shift detecting member can have a cylindrical shape.

Figure 25:
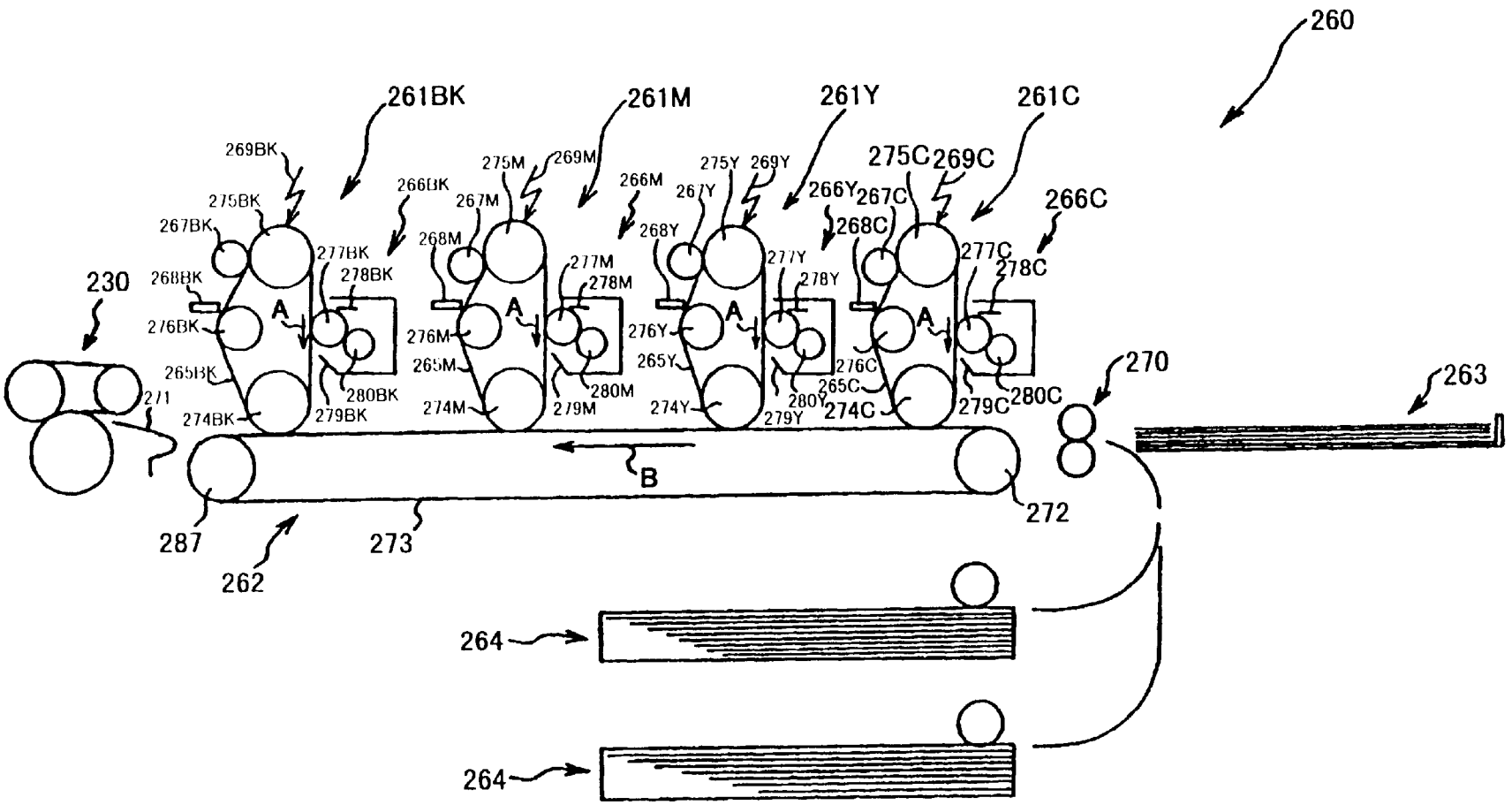
FIG. 25 is a schematic cross-sectional view that illustrates a full-color image forming apparatus employing the belt driving device of the present invention.

More than three belt winding rollers can be used, as illustrated in FIG. 25, and more than two winding rollers can be moved at the ends. Further, one end of the driving roller can be vertically moved. The hole 208 can include a variety of shapes as long as it permits movement of the bearing 211 without the bearing member contacting the inner side edge of the hole.

One end of driven roller 202 can be moved in a direction Z2. However, if the endless belt 203 is wound around the rollers in a manner such that it always shifts in a particular side direction, the belt shift detecting member can be positioned only on the side to which the endless belt 203 shifts. For example, a reinforcing member having high modulus of elasticity is mounted on a surface of the endless belt 203 at an end opposite to the shift detecting member so that the end of the endless belt 203 hardly stretches relative to the other end of the endless belt 203. In this case, the endless belt 203 may always overlap the belt shift detecting member. The endless belt having the reinforcing member has relatively a longer lifetime, even if the prescribed end always contacts the belt shift detecting member. Further, the contacting member can be a belt, a blade, etc.

A belt type fixing apparatus employing a belt shift suppressing device is explained below with reference to FIG. 22.

A variety of sheet state mediums including a 90 kilogram paper such as plain paper, an OHP sheet, and a card may be used. Further, a sheet having a heat capacitance larger than that of plain paper (e.g., an envelope or a thick paper having more than 100 gram per square meter which is measured by dividing a whole weight of one paper roll manufactured in a factory by the length and width of the paper wound around the roll) may be used.

The belt type fixing apparatus includes a belt driving device 220. The belt driving device 220 includes a driven roller 202 and a heater 221 disposed in a shaft 202*a* of the driven roller 202. The driven roller 202 rotates an endless belt 203, and has a belt shift suppressing device illustrated in FIG. 16 at its one end. The one end of the driven roller 202 is moved by the belt shift suppressing device in directions X1 and X2. A pressure roller 222 as a contacting member is employed and pressure contacts the endless belt 203 against the driving roller 201. A driven roller 202 functions as a heating roller, since it has the heater 221 therein. The shaft 222*a* of the pressure roller 222 is connected with one end of compression springs 223. The other end of the compression springs 223 is connected to the body. The spring 223 obliquely and upwardly biases the shaft 222*a* from a lower side of the shaft 222*a*.

The driven roller 202 is biased by a spring 214 with a force P2 in a rightward inclined direction. The biasing force P1 of the spring 223 is made larger than that of the force P2. The endless belt 203 includes a film-like base member and a release layer disposed on the base member. The base member is made of, for example, stainless steal, iron, nickel, and/or polyimide resins having heat resistance characteristics suitable for use in the copier. The endless belt 203 is made of nickel and has a thickness of about 150 $\mu$m. However, the thickness can range from about 30 $\mu$m to about 300 $\mu$m.

Thin endless belts are generally easily susceptible to damage at their edges because wrinkling and a buckling of endless belts frequently occurs due to a belt shift when a heat stress is applied to the endless belts. However, since the belt driving device 220 may suppress the belt shift, and the belt shift detecting member may be worn away when rubbed by the endless belt 203, the problem does not occur, and accordingly, the lifetime of the belt can be extended.

When the nickel for the base member is used, a reinforcing material such as manganese can be blended therein with a few weight percent to improve both tensile strength and compression strength by increasing the modulus of elasticity. Because, the nickel has a heat character such that its tensile strength is weakened, and the endless belt 203 may be broken when used in more than 100° C. The belt shift detecting member used in the fixing device 220 is made of, for example, engineering plastic that is preferably heat resistant.

The fixing operation is successively executed at both a first fixing section 224*a* and a second fixing section 224*b* located downstream of the first fixing section 224*a*. The first fixing section 224*a* is formed on a portion of the circumference of the pressure roller 222, in which only the endless belt 203 pressure contacts the pressure roller 222. The second fixing section 224*b* is formed at a nip portion formed between the driving roller 201 and the pressure roller 222.

The belt type fixing apparatus further includes an oil applying roller 281 for applying oil as a release agent that permits the sheet medium to be easily peeled off of the endless belt 203 at the nip portion. The belt type fixing apparatus further includes a cleaning roller 282 for cleaning the endless belt 203. Both the oil applying roller 281 and the cleaning roller 282 have a shape nearly identical to the contacting member 285 illustrated in FIG. 21. The pressure roller 222 and the oil applying roller 28 are disposed around the driving roller 201 in a manner such that each axis is positioned within an angle of 30° when measured either clockwise or counter clockwise around the axis of the fixing roller from a vertical line passing through the axis of the driving roller 201. The cleaning roller 282 contacts only a surface of the endless belt 203 wound around the driving roller 201. A cleaning blade 283 pressure contacts the surface of the cleaning roller 282 to clean the surface. The belt shift detecting member can be disposed at both sides of the driven roller 202.

As illustrated in FIG. 21, an area of the endless belt 203 to which oil is applied (indicated by oblique lines) has a width larger than that of the sheet medium and smaller than that of the endless belt 203. Thus, toner offset and wear of the endless belt 203 due to contact with the sheet medium can be avoided. Further, the oil does not reach the belt shift detecting member 205. The endless belt 203 is heated by the heater 221 and rotated by the driving roller 201 around the driving roller 201 and the driven roller 202 in a direction 204. The endless belt 203 transports the sheet medium toward the fixing area 224. The toner image carried on the sheet medium gradually melts and is temporarily fixed on the sheet medium when passing through the first fixing section 224*a*. The toner image is fixed thereon when passing through the second fixing section 224*b*. This process is facilitated by the pressure between the driving roller 201 and the pressure roller 222.

Since the belt shift suppressing member 205 of the belt driving device 220 suppresses the belt shift, the sheet medium can be smoothly transported without wrinkling and buckling, and accordingly, a good fixing operation can be executed. Further, debris on the endless belt can be removed by the cleaning roller 282. Further, since both the pressure roller 222 and the oil applying roller 281 are positioned around the surface of the belt driving roller 201 contacting the endless belt 203, they do not interfere with the up-down movement of the end of the driven roller 202. Further, contact conditions of both the pressure roller 222 and the oil applying roller 281 to the endless belt 203 do not change during the up-down movement. Thus, if the above-mentioned fixing device is employed in a copier, a facsimile, a printer and so on, a good image can be obtained. The positional relation between the cleaning roller 282 and the oil applying roller 281 can be exchanged with each other when a higher cleaning ability is desired.

Below, a modified belt type fixing device having a belt driving device is described with reference to FIG. 23.

The composition of the belt driving device 220' of the modified belt type fixing device is nearly the same as employed in the belt driving device 220. As shown in FIG. 23, the belt driving device 220' employs a pair of springs 214*a* and 214*b*, which apply a predetermined level of tension to a driven roller 221 in the X1 and X2 directions, respectively. A pressure roller 231 contacts a surface of a driving roller 201 from an upper side of the driven roller 201. A spring 232 biases a driving roller 201 upwardly through a shaft 201*a* of the driving roller 201 from the lower side of the shaft 201*a*. Thus, a pressure is obtained between the driving roller 201 and the pressure roller 231. The pressure roller 231 includes a heater 221 in its shaft 231*a*. Thus, the pressure roller 231 functions as a heating roller in this embodiment. A silicon oil applying roller 233 contacts the surface of the pressure roller 231 to apply silicon oil.

A cleaning roller 234 contacts the surface of the pressure roller 231 to remove debris accumulated on and/or attracted to the surface of the pressure roller 231. A cleaning blade contacts the surface of the cleaning roller 234 to clean the surface of the cleaning roller 234.

A belt cleaning roller 236 contacts the surface of the endless belt 203 to clean the surface of the endless belt 203. A cleaning blade 236 contacts the surface of the belt cleaning roller 236 to clean the surface of the belt cleaning roller 236. A fixing area in which a fixing operation is executed, is formed at an area of contact (i.e., a contact portion) between the driving roller 201 and the pressure roller 231. A guide member 239 is disposed above the belt driving device 220' to lead a sheet medium having an unfixed toner image thereon toward the fixing area. The belt shift suppressing member illustrated in FIG. 16 is attached to one side or both sides of the driven roller 202. The pressure roller 231 can be disposed at any location as long as the contacting the surface of the endless belt 203 is maintained against the driving roller 201 or adjacent to the driving roller 201. The device constructed in this manner can obtain the same results as described above for the second embodiment.

Below, another modified belt type fixing device having a belt shift suppressing device is explained with reference to FIG. 24.

The modified belt type fixing device includes a pair of belt driving devices 220' and 220" which are constructed similar to the belt driving device 220' shown in FIG. 23. However, a roller 241 winding an endless belt is driven by the endless belt 203' of the belt driving device 220". The belt driving device 220" is positioned above the belt driving device 220'. The roller 241 contacts the surface of the endless belt 203' against the driving roller 201. Thus, the roller 241 functions as a pressure roller and a fixing roller. A contact pressure between both endless belts 203 and 203', which is required to fix a toner image, is obtained by a spring 232 that biases in the same manner as explained above. A heater 221 is disposed inside the shaft 202*a*' of the driven roller 202' as a heating roller of the belt driving device 220". An oil applying roller 242 for applying silicon oil as a release agent to the surface of the endless belt 203' presses the endless belt 203' against the driven roller 241.

A belt cleaning roller 243 for removing debris sticking to the surface of the endless belt 203' presses the endless belt 203' against the driven roller 241. A cleaning blade 244 contacts the belt cleaning roller 243 to clean its surface. Thus, a contact area between the driving roller 201 and the driven roller 241 forms the fixing area 245.

Further, the endless belt 203' and the roller 201 rotate in opposite directions. The sheet medium having an unfixed toner image thereon is fed between both endless belts 203 and 203' toward the fixing area 245. The belt shift suppressing device illustrated in FIG. 16 is attached to one end or both ends of both driven rollers 202 and 202. An oil applying roller 242 can be provided in the same manner as the oil applying roller 285 illustrated in FIG. 21.

The above-mentioned belt contacting members can be a plate state instead of a roller state as illustrated in FIG. 24. A heater can be disposed at any place as far as possible to apply heat to the endless belt 204 instead of disposing in the shaft 202'*a*. For example, the heater can be disposed at an inside of the endless belt 203. Further, the endless belts 203' and 204, have almost same construction and material with the endless belt 203 illustrated in FIG. 22.

The contacting members, such as the pressure roller, are disposed at predetermined positions so that they do not interfere the vertical movement of the end of the driven roller 202'. The respective contact areas of the contacting members on the endless belts 203' and 204' do not change during the movement of the belts 203' and 204'.

Below, a color image forming apparatus employing a plurality of belt driving devices and a belt type fixing device having a belt shift suppressing device is explained with reference to FIG. 25.

The color image forming apparatus 260 includes a plurality of monochrome color image forming sections 261C, 261Y, 261M and 261B for forming a cyan color toner image, a yellow color toner image, magenta color toner image, and a black color toner image, respectively. The color image forming apparatus 260 further includes a belt type transfer device 262 for transferring each of the color toner images onto a sheet medium.

A sheet inserting tray 263 and a plurality of sheet cassettes 264 are provided. A registration roller 270 is also provided to feed sheets to each of the monochrome toner transfer stations in synchronism with the formation of each of the monochrome toner images. A fixing device 230 to is provided downstream of the last transfer station to fix the monochrome toner images to the sheet medium. The transfer device 262 is includes one of the belt driving devices illustrated in FIGS. 22, 23 and 24. Namely, a roller 272 functions as a driven roller having the above-mentioned belt shift suppressing device at one or both of its ends.

An endless belt 273 can be constructed similar to any of the endless belts described above. Thus, the endless belt 273 is not easily worn away. Since, the monochrome toner image forming units are constructed nearly identical to one another, the following description of a cyan toner image forming unit 261*c* is applicable to any of the other monochrome toner image forming units.

A conventional monochrome toner image forming device may be used as the cyan toner image forming unit 261*c*. The section 261*c* includes a PC belt 265*c* for carrying a cyan toner image thereon. A charge applying device 267*c*, a developing device 267*c* and a cleaning device 268*c* are arranged around the PC belt 265*c* in that order. A light beam having image information exposes the surface of the PC belt 265*c* between the charge applying device 267*c* and the developing device 266*c*.

A driving roller 275*c*, a driven roller 274*c* pressure contacting the surface of the endless belt 273 and a second driven roller 276*c* are employed to wind the PC belt 265*c* therearound. A cleaning member 268*c* is provided to contact the surface of the PV belt 265*c* adjacent to the second driven roller 276*c*. The developing device 266*c* includes a toner supplying roller 277*c* for drawing up the toner contained in a casing 279*c* and a developing roller 280*c* for receiving the toner from the toner supplying device 280*c* and applying it to the PC belt 265*c*.

A toner layer thickness regulation blade 278*c* is provided to regulate the thickness of the toner layer formed on the surface of the developing roller 277*c*. A drum type PC can be used for the belt type PC 265*c*.

A positional relation between a contacting member and an endless belt as mentioned earlier referring to FIGS. 21, 22, and 23 may be created between the endless belt 273 and the PC belt 265*c*. Further, the same positional relation is applied between the PC belt 265*c* and the charge applying roller 267*c*, the second driven roller 276*c* and the cleaning device 268*c*, the PC belt 065*c*, and the developing device 266*c*. Further, the full color image forming apparatus includes a belt type fixing device 230 including a fixing endless belt and a fixing pressure roller pressure contacting the fixing endless belt as illustrated in FIG. 25. Thus, the fixing pressure roller and the fixing endless belt create the above-mentioned positional relation.

The contacting members, such as the cleaning member 268*c*, are positioned at predetermined positions so that they do not interfere with the movement of the driven roller and the contact condition between the contacting members and the endless belt does not change during movement.

The above-mentioned full color image forming device is controlled to operate in a conventional manner. However, since the belt shift suppressing device is attached to at least one end of the driven roller disposed in the monochrome image forming section 261*c* and the fixing device 230, the belt shift may be suppressed during the operation.

Figure 19:
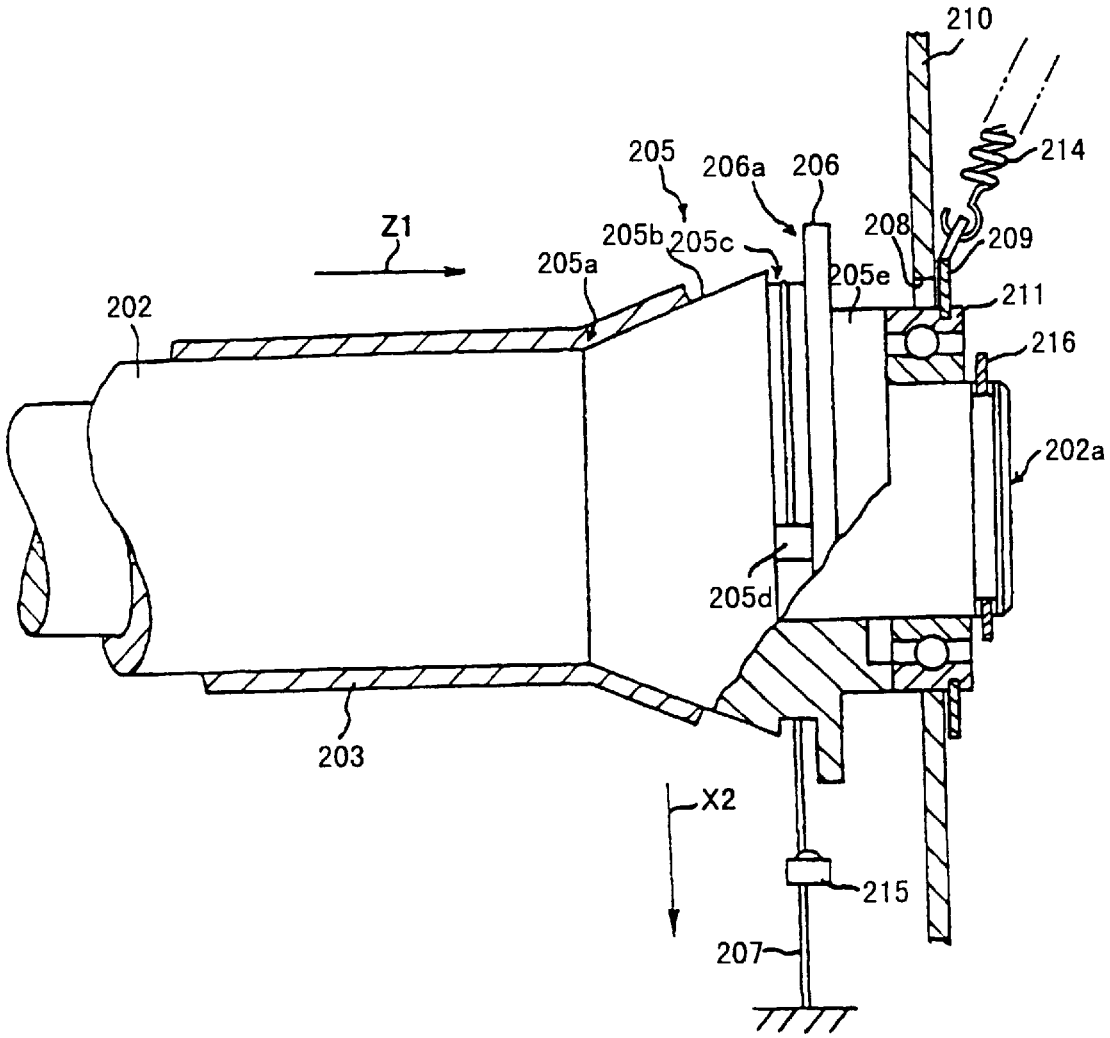
FIG. 19 is a front side view including a partially cut away view of the principal portion of the belt driving device illustrated in FIG. 16, which illustrates the shift of the endless belt overlying a belt shift detecting roller of the belt shift suppressing mechanism.
Figure 20:
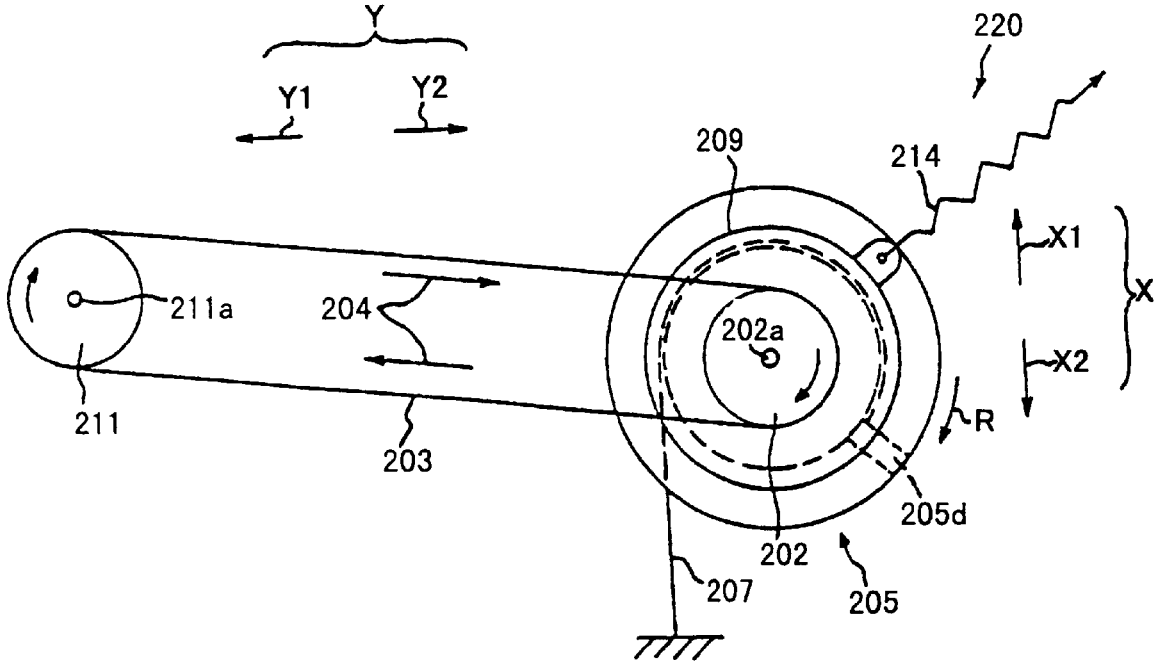
FIG. 20 is a schematic front side view of the belt driving device illustrated in FIG. 18 which illustrates downward movement of one end of the driven roller.

An endless color toner receiving belt for receiving each of the monochrome toner images thereon at transfer stations can be used for the transfer belt 273. The endless color toner receiving belt can be driven by a belt driving device having a belt shift suppressing device as illustrated in FIG. 19 and 22.

Further, to suppress the above-mentioned belt shift, one end of the driven roller can be moved horizontally as illustrated in FIGS. 14, 15, 22, 23 and 24 in the Y1 and Y2 directions.

Obviously, numerous modifications and variations of the present invention are possible in light of the above teachings. It is therefore to be understood that within the scope of the appended claims, the present invention may be practiced otherwise than as specifically described herein.

This application is based upon Japanese Patent Application No. 10-053769 (filed on Mar. 5, 1998) and upon Japanese Application No. 10-248980 (filed on Sep. 3, 1998). Japanese patent application Nos. 10-053769 and 10-248980 and all references cited therein are incorporated herein by reference.

What is claimed is:

1. An image forming apparatus, comprising:

an endless belt;

first and second belt winding rollers configured to rotate the endless belt;

a belt shift detecting device configured to detect a shift of the endless belt;

a roller end moving device configured to move a first end of the first belt winding roller around a second end of the first belt winding roller in response to a detection of a shift of the endless belt to suppress the shift of the endless belt within a predetermined range; and a belt surface contacting device configured to pressure contact the endless belt, the belt surface contacting device being mounted on a frame configured to support a shaft of the first belt winding roller.

2. An image forming apparatus as claimed in claim 1, wherein the belt surface contacting device comprises:

a contact roller configured to pressure contact a surface of the endless belt; and a bias spring configured to apply a bias to the contact roller, one end of the bias spring being connected with a portion of the frame and another end of the bias spring being connected with the contact roller.

3. An image forming apparatus as claimed in claim 1, further comprising:

a sliding member mounted on a base plate of the image forming apparatus and configured to slide substantially horizontally and guide the frame substantially vertically.

4. An image forming apparatus as claimed in claim 1, wherein the endless belt comprises:

a heat applying member configured to fix a toner image to a sheet; and wherein the belt surface contact device comprises:

an oil applying member configured to apply oil to a surface of the heat applying member.

5. An image forming apparatus as claimed in claim 1, wherein the endless belt comprises:

a photoconductive member configured to carry a toner image; and wherein the belt surface contacting device comprises:

a cleaning member configured to clean a surface of the photoconductive member.

6. An image forming apparatus, comprising:

an endless belt;

first and second belt winding rollers configured to rotate the endless belt;

a belt shift detecting device configured to detect a shift of the endless belt;

a roller end moving device configured to move a first end of the first belt winding roller around a second end of the first belt winding roller in response to a detection of a shift of the endless belt to suppress the shift of the endless belt within a predetermined range; and a belt surface contacting device configured to contact a portion of the endless belt contacting a circumference of the second belt winding roller.

7. An image forming apparatus as claimed in claim 6, wherein the endless belt comprises:

a photoconductive member configured to carry a toner image; and wherein the belt surface contacting device comprises:

a cleaning member configured to clean a surface of the photoconductive member.

8. An image forming apparatus as claimed in claim 6, wherein the endless belt comprises:

a heat applying member configured to fix a toner image to a sheet; and wherein the contacting member comprises:

a release agent applying member configured to appy a release agent to the heat applying member.

9. An image forming apparatus as claimed in claim 6, wherein the endless belt comprises:

a photoconductive member configured to carry a latent image; and wherein the belt contacting device comprises:

a developing roller configured to develop the latent image formed on the photoconductive member.

10. An image forming apparatus as claimed in claim 6, wherein the endless belt comprises:

a heat applying member configured to fix a toner image to a sheet; and wherein the contacting member comprises:

a pressure roller configured to apply pressure to the endless belt during a fixing operation.

11. A full color image forming apparatus, comprising:

a plurality of monochrome toner image forming sections, each monochrome toner image forming section being configured to form monochrome toner images in a different color; and a transfer belt configured to transfer each of the monochrome toner images to a printing medium;

wherein each of the monochrome toner image forming sections includes:

an endless belt configured to carry a toner image;

first and second belt winding rollers configured to rotate the endless belt;

a belt shift detecting device configured to detect a shift of the endless belt;

a roller end moving device configured to move a first end of the first belt winding roller around a second end of the first belt winding roller in response to a detection of a shift of the endless belt to suppress the shift of the endless belt within a predetermined range; and a belt surface contacting device configured to contact a portion of the endless belt contacting a circumference of the second belt winding roller.

12. An image forming apparatus, comprising:

first and second belt winding means for rotating an endless belt;

belt shift detecting means for detecting a shift of the endless belt;

roller end moving means for moving a first end of the first belt winding means around a second end of the first belt winding means in response to a detection of a shift of the endless belt to suppress the shift of the endless belt within a predetermined range;

belt surface contacting means for pressure contacting the endless belt, the belt surface contacting means being mounted on frame means for supporting a shaft of the first belt winding means moved by the roller end moving means.

13. An image forming apparatus, comprising:

belt winding means for rotating an endless belt;

belt shift detecting means for detecting a shift of the endless belt;

first and second roller end moving means for moving a first end of the first belt winding means around a second end of the first belt winding means in response to a detection of a shift of the endless belt to suppress the shift of the endless belt within a predetermined range; and belt surface contacting means for contacting a portion of the endless belt contacting a circumference of the second belt winding means.

14. A method for suppressing belt shift in an image forming apparatus, comprising the steps of:

rotating an endless belt with first and second belt winding rollers;

detecting a shift of the endless belt with a belt shift detecting device;

moving, in response to detecting the shift of the endless belt, a first end of the first belt winding roller around a second end of the first belt winding roller with a roller end moving device to suppress the shift of the endless belt within a predetermined range; and pressure contacting the endless belt with a belt surface contacting device mounted on a frame supporting a shaft of the first belt winding roller.

15. A method as claimed in claim 14, wherein the pressure contacting step comprises the steps of:

pressure contacting a surface of the endless belt with a contact roller; and applying a bias to the contact roller with a bias spring, one end of the bias spring being connected with a portion of the frame and another end of the bias spring being connected with the contact roller.

16. A method as claimed in claim 14, further comprising the steps of:

guiding the frame substantially vertically with a sliding member mounted on a base plate of the image forming apparatus and configured to slide substantially horizontally.

17. A method as claimed in claim 14, further comprising the steps of:

fixing a toner image to a sheet with a heat applying member; and applying oil to the surface of the heat applying member with an oil applying member.

18. A method as claimed in claim 14, further comprising the steps of:

carrying a toner image with a photoconductive member; and cleaning a surface of the photoconductive member with a cleaning member.

19. A method for suppressing a belt shift in an image forming apparatus, comprising:

rotating an endless belt with first and second belt winding rollers;

detecting a belt shift of the endless belt with a belt shift detecting device;

moving, in response to the detection of a shift of the endless belt, a first end of the first belt winding roller around a second end of the first belt winding roller to suppress the shift of the endless belt within a predetermined range;

contacting a portion of the endless belt with a belt surface contacting device; and contacting a circumference of the second belt winding roller with the portion of the endless belt contacted by said belt surface contacting device.

20. A method as claimed in claim 19, further comprising the steps of:

carrying a toner image with a photoconductive member; and cleaning a surface of the photoconductive member with a cleaning member.

21. A method as claimed in claim 19, further comprising the steps of:

fixing a toner image on a sheet with a heat applying member; and applying a release agent to the heat applying member with a release agent applying member.

22. A method as claimed in claim 19, further comprising the steps of:

carrying a latent image with a photoconductive member; and developing the latent image formed on the photoconductive member with a developing roller.

23. A method as claimed in claim 19, further comprising the steps of:

fixing a toner image to a sheet with a heat applying member;

applying pressure to the endless belt during a fixing operation with a pressure roller.

24. A method for correcting a belt shift in a full color image forming apparatus, comprising:

forming monochrome toner images with a plurality of monochrome toner image forming sections, each monochrome toner image forming section corresponding to a different color; and transferring each of the monochrome toner images to a printing medium with a transfer belt;

carrying a toner image with an endless belt;

rotating the endless belt with first and second belt winding rollers;

detecting a belt shift of the endless belt with a belt shift detecting device;

moving, in response detecting the shift of the endless belt, a first end of the first belt winding roller around a second end of the first belt winding roller with a roller end moving device to suppress the shift of the endless belt within a predetermined range; and contacting a portion of the endless belt with a belt surface contacting device; and contacting a circumference of the second belt winding roller with the portion of the endless belt contacted by said belt surface contacting device.

* * * * *